US006132120A

United States Patent [19]

Yamaguchi et al.

[11] Patent Number: 6,132,120

[45] **Date of Patent: *Oct. 17, 2000**

[54] TAPE-SHAPED LABEL PRINTING DEVICE

[75] Inventors: Koshiro Yamaguchi, Kasugai; Susumu Misu, Kuwana; Yutaka Sugiyama, Nagoya; Kiyoshi Sugimoto, Kuwana; Takashi Horiuchi, Chiryu, all of Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/790,458

[22] Filed: Jan. 29, 1997

Related U.S. Application Data

[63] Continuation-in-part of application No. 08/621,835, Mar. 26, 1996, Pat. No. 5,964,539, which is a continuation-in-part of application No. 08/450,356, May 25, 1995, Pat. No. 5,653,542.

[30] Foreign Application Priority Data

| | | | |
|---|---|---|---|
| Mar. 29, 1995 | [JP] | Japan | 7-100061 |
| Jan. 31, 1996 | [JP] | Japan | 8-015082 |

[51] Int. Cl.[7] ..... B41J 15/00

[52] U.S. Cl. ..... 400/615.2; 400/586

[58] Field of Search ..... 400/586, 582, 400/615.2

[56] References Cited

U.S. PATENT DOCUMENTS

| | | | |
|---|---|---|---|
| D. 317,172 | 5/1991 | Miyamoto et al. | D18/12 |
| D. 342,275 | 12/1993 | Cooper | D18/12 |
| D. 361,342 | 8/1995 | Hattori et al. . | |
| 4,402,619 | 9/1983 | Paque et al. | 400/36 |
| 4,557,617 | 12/1985 | Richardson et al. | 400/208 |
| 4,652,154 | 3/1987 | Horiya et al. | 400/208 |
| 4,776,714 | 10/1988 | Sugiura et al. | 400/248 |
| 4,815,871 | 3/1989 | McGourty et al. | 400/120 |
| 4,815,875 | 3/1989 | Richardson et al. | 400/208.1 |
| 4,927,278 | 5/1990 | Kuzuya et al. | 400/208 |
| 4,930,913 | 6/1990 | Basile | 400/120 |
| 4,966,476 | 10/1990 | Kuzuya et al. | 400/208 |
| 5,017,942 | 5/1991 | Asakura et al. | 346/76 PH |
| 5,022,771 | 6/1991 | Paque | 400/120 |
| 5,056,940 | 10/1991 | Basile | 400/120 |
| 5,120,147 | 6/1992 | Ozaki | 400/649 |
| 5,165,806 | 11/1992 | Collins | 400/120 |
| 5,188,469 | 2/1993 | Nagao et al. | 400/615.2 |
| 5,195,835 | 3/1993 | Collins | 400/248 |
| 5,232,297 | 8/1993 | Kitazawa . | |
| 5,277,503 | 1/1994 | Nagao | 400/208 |
| 5,302,034 | 4/1994 | Kitazawa | 400/615.2 |
| 5,348,406 | 9/1994 | Yoshiaki et al. | 400/615.2 |
| 5,350,243 | 9/1994 | Ichinomiya et al. | 400/208 |

(List continued on next page.)

FOREIGN PATENT DOCUMENTS

| | | |
|---|---|---|
| 24609-01 | 2/1994 | Benelux TM/Des. Off. . |
| 0-573187 | 12/1993 | European Pat. Off. . |
| 0-607023 | 7/1994 | European Pat. Off. . |
| 0-625427 | 11/1994 | European Pat. Off. . |
| 0-641663 | 3/1995 | European Pat. Off. . |
| 940681 | 2/1994 | France . |
| 9401507 | 2/1994 | Germany . |
| 2-106555 | 4/1990 | Japan . |
| 5-84994 | 4/1993 | Japan . |
| 5-238027 | 9/1993 | Japan . |
| 121073 | 2/1994 | Switzerland . |
| 2037151 | 8/1994 | United Kingdom . |

*Primary Examiner*—John S. Hilten
*Attorney, Agent, or Firm*—Oliff & Berridge, PLC

[57] ABSTRACT

A first printing is performed after text is inputted and after a number of print colors, a print color order, and their print ranges are set. A message urging the user to remove the ribbon cassette in order to perform a second printing is displayed. When the user opens the cassette cover, removes the ribbon cassette, and inputs using an optional or predetermined key, then a message warning the user not to mount a ribbon cassette is displayed and rewind of the tape is started. When the front edge of the tape is detected by a tape detection sensor, then rewind of the tape is stopped.

39 Claims, 25 Drawing Sheets

U.S. PATENT DOCUMENTS 5,374,132 12/1994 Kimura ..... 400/586
5,382,100 1/1995 Sakuragi et al. ..... 400/615.2
5,411,339 5/1995 Bahrabadi et al. ..... 400/56
5,419,643 5/1995 Matsuura ..... 400/208
5,443,319 8/1995 Sugiura et al. ..... 400/208
5,454,650 10/1995 Yamaguchi ..... 400/208
5,462,372 10/1995 Hirono ..... 400/615.2
5,500,669 3/1996 Yamashita et al. ..... 400/208
5,533,818 7/1996 Bahrabadi ..... 400/208
5,536,092 7/1996 Yamaguchi ..... 400/649
5,538,352 7/1996 Sugiura ..... 400/615.2
5,595,447 1/1997 Takayama et al. ..... 400/231
5,595,450 1/1997 Beadman et al. ..... 400/615.2
5,649,775 7/1997 Sakuragi et al. ..... 400/615.2
5,653,542 8/1997 Sugimoto et al. ..... 400/248
5,681,420 10/1997 Yamane ..... 400/615.2
5,685,654 11/1997 Nagao et al. ..... 400/615.2

121

| | |
|---|---|
| A | RED |
| B | RED |
| SP | |
| C | GREEN |
| D | GREEN |
| E | GREEN |
| SP | |
| F | BLACK |
| G | BLACK |
| | |

TAPE-SHAPED LABEL PRINTING DEVICE

CROSS-REFERENCE TO RELATED APPLICATION

This is a continuation-in-part of application Ser. No. 08/450,356, filed May 25, 1995, now U.S. Pat. No. 5,653,542.

This application is a continuation-in-part of application Ser. No. 08/621,835, filed on Mar. 26, 1996, now U.S. Pat. No. 5,964,539.

BACKGROUND OF THE INVENTION

1. Field of the Invention

The present invention relates to a tape-shaped label producing device and in particular to preventing rewind of the ink ribbon in a ribbon cassette when rewinding a printed tape in order to repeatedly print on the same print region.

2. Description of the Related Art

U.S. Pat. No. 5,232,297 describes a tape-shaped label printing device, which prints characters and marks, such as alphabetic characters and symbols, on a tape printing medium and is thus suitable for making labels to adhere to file tabs. This tape-shaped label printing device includes a keyboard, a display, and a printing mechanism of the thermal printing type, and is configured to print characters, marks, and the like in a variety of font styles and sizes on a printing tape medium of widths such as 6, 9, 12, 18, and 24 mm.

SUMMARY OF THE INVENTION

It is conceivable to configure a tape-shaped label printing device capable of moving the print tape not only in the feed direction but also in a rewind direction. The device can be used to produce a tape-shaped label printed with composite characters, design patterns, and the like by first printing characters, symbols, and the like on the print tape in a first printing, rewinding the print tape to the starting position of the first printing, and then again printing characters, symbols, and the like in the same region in a second printing.

The tape-shaped labels printed with character trains are not limited to use as labels for file tabs. These labels are also appropriate for sticking on cassettes and their cases, or video tapes and their cases, for example. In such a case, the character trains may be colorfully printed in multiple colors in accordance with recorded content and genre by repeatedly printing on the tape after rewinding it before each printing.

It is conceivable to create a plurality of ribbon cassettes, separate from the tape cassette, housing not only black ink ribbons, but ink ribbons in a plurality of colors such as red, green, and blue. Each of the ribbon cassettes is detachably mountable to the tape cassette. The tape-shaped label producing device executes a color range setting process to serially set an order in which the print colors are to be printed during multicolor printing and to set, to the inputted text, a print target range for each print color for printing in the plurality of set colors. Print processes are performed while serially changing the ribbon cassette to the one that matches the present print color. The print tape is rewound to its print start position after each print operation. By controlling in this fashion, labels printed with composite characters, design patterns, and the like can be prepared and colorful labels can be printed in a plurality of colors.

In this conceivable device, the ribbon cassettes are provided with a ribbon spool wound with an ink ribbon and a ribbon take-up spool for taking up the ink ribbon. Spent ink ribbon used during the printing process is taken up by driving the ribbon take-up spool to rewind the ink ribbon in association with feed operations of the print tape.

As mentioned above, in order to produce a colorful label printed with a plurality of colors or a label printed with composite characters, design patterns, and the like, the print tape is rewound to its print start position with each printing operation and printing is performed using one ink ribbon cassette or by serially switching different colored ribbon cassettes. However, because the ribbon takeup spool is driven in association with feed operations of the print tape, the ink ribbon wound around the ribbon takeup spool would be fed out by a large amount and become tangled when the ribbon take-up spool in the ribbon cassette is driven in association with rewinding of the print tape to rewind in a direction opposite that for ribbon take up. Therefore, the tape-shaped label producing device must be provided with a connection releasing mechanism for preventing the ribbon take-up spool from being driven in association with rewinding of the print tape. However, this would complicate the configuration of the thermal printing mechanism and also increase its size.

When the user accidentally operates the delete key on the keyboard during exchange of the ribbon cassettes, then printing operations would be terminated even if the user is in the middle of a multi-color printing operation. The tape printed up to that point will be wasted. Also, the user will become frustrated by having to repeat operations.

It is an objective of the present invention to overcome the above-described problems and to provide a tape-shaped label producing device for preventing the ink ribbon from being rewound when the tape movement mechanism rewinds the tape, without providing a connection releasing mechanism of any kind for preventing the ribbon take-up spool in the ribbon cassette from rewinding, and for preventing printing operations from being terminated by accidental operation of an input device during exchange of ribbon cassettes.

In order to achieve the above-described objectives, a tape-shaped label producing device according to the present invention includes a input device for inputting characters, symbols, and a variety of commands; a data memory for storing inputted text data; a tape movement mechanism for moving a tape selectively in a feed direction and in a rewind direction; a ribbon cassette housing an ink ribbon and detachably mounted; a cassette detector for detecting presence and absence of the ribbon cassette; a print device including a print head for printing on the tape; a controller for controlling printing; and a tape rewind controller for, when the cassette detector detects absence of the ribbon cassette, controlling the tape movement mechanism to rewind the tape.

With this configuration, when data of text inputted by the input device is stored in the data memory, then the controller controls printing operations of the print device so that the print head of the print device prints on the tape via the ink ribbon of the mounted ribbon cassette. When, during rewinding of the tape, the tape rewinding controller detects, using the detection signal from the cassette detector, that a ribbon cassette is removed, it will use the tape movement device to move the tape in the rewind direction.

According to another aspect of the present invention, a plurality of ribbon cassettes are provided. Each of the ribbon cassettes houses one of a plurality of colored ink ribbons and is selectively and freely detachably mounted for sequentially printing in the plurality of colors.

With this configuration, when, after completion of each printing process, a selectively mounted ribbon cassette of a plurality of ribbon cassettes prepared for multi-color printing is detected as being removed, then the tape rewind controller uses the tape movement mechanism to rewind the tape upon key input from the input device.

According to other aspects of the invention, the tape rewinding controller will automatically use the tape movement mechanism to execute tape rewind by either optional or specific key input from the input device.

A tape detector for detecting presence and absence of tape can be provided near the end of a tape movement pathway of the tape movement mechanism. In this case, the tape rewinding controller stops rewinding of the tape when the end of the tape is detected using the detection signal from the tape detector.

According to another aspect of the present invention, a tape-shaped label producing device includes an input device for inputting characters, symbols, and a variety of commands; a data memory for storing inputted text data; a tape movement mechanism for moving a tape selectively in a feed direction and in a rewind direction; a ribbon cassette housing an ink ribbon and detachably mounted; a cassette detector for detecting presence and absence of the ribbon cassette; a print device including a print head for printing on the tape; a controller for controlling printing; and a tape rewind controller for, when the cassette detector detects absence of the ribbon cassette, controlling the tape movement mechanism to rewind the tape to a print start position of the tape.

BRIEF DESCRIPTION OF THE DRAWINGS

The above and other objects, features, and advantages of the invention will become more apparent from reading the following description of the preferred embodiment taken in connection with the accompanying drawings in which:

FIG. 28(*b*) is an explanatory diagram showing a point at which the tape has been supplied by the length of the front margin;

FIG. 28(*c*) is an explanatory diagram showing the point at which the tape has been further supplied by a distance of idle feeding;

DETAILED DESCRIPTION OF THE PREFERRED EMBODIMENT

Figure 1:
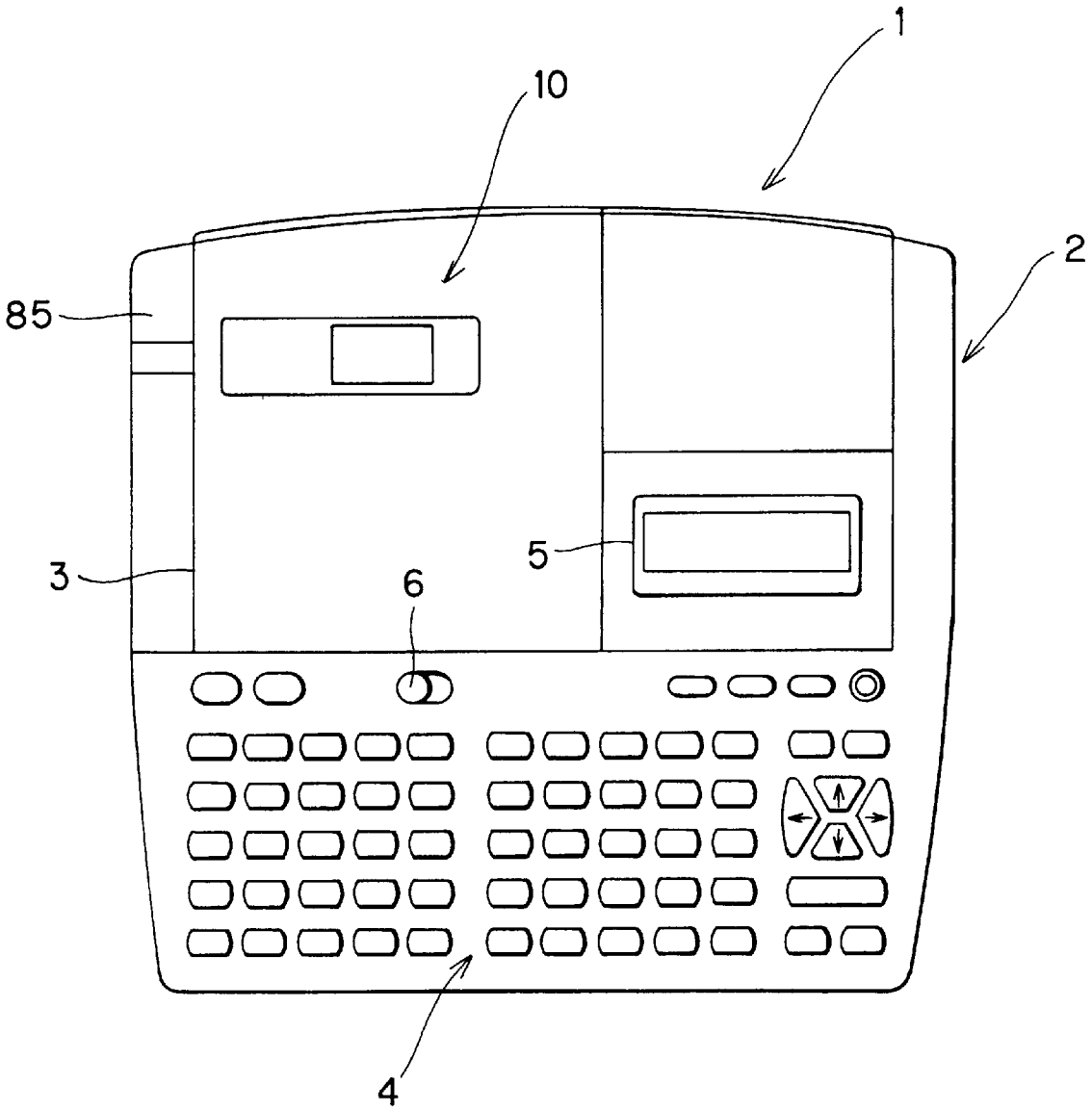
FIG. 1 is a plan view showing a tape-shaped label printing device according to an embodiment of the present invention.

A tape-shaped label producing device according to the present invention will be described while referring to the accompanying drawings wherein like parts and components are designated by the same reference numerals to avoid duplicating description.

The present embodiment is applied to a tape-shaped label printing device capable of printing characters, symbols, and the like in a plurality of colors on a printing tape, which is a printing medium, by exchanging a plurality of ribbon cassettes each with a different ribbon color.

As shown in FIG. 1, a keyboard 4 is arranged on the front portion of the main cover 2 of a tape-shaped label printing device 1. The keyboard 4 is provided with various function keys and includes keys such as character keys, symbol keys, and numeric keys. Immediately behind the keyboard 4, a liquid crystal display 5 capable of displaying the input characters, symbols, and the like is provided. A thermal printing mechanism 10 containing a thermal head 12 is provided within the main cover 2. The thermal head 12 is provided at a position corresponding to a cassette cover 3, which is opened and closed to allow exchanging of ribbon cassettes 30. A slide knob 6 is slidably provided for opening the cassette cover 3. A cutting knob 85 is also provided, and is pressed down for manually cutting a printing tape 22 which has been printed on.

Next, the thermal printing mechanism 10 including the thermal head 12 will be described with reference to FIGS. 2 through 8.

First, a tape cassette 20 detachably mounted on the thermal printing mechanism 10 will be described with reference to FIGS. 2 through 5 and FIG. 7.

A tape spool 23 is rotatably provided on the inside of a tape case 21 of the tape cassette 20. Around the tape spool 23 is wound a printing tape 22 formed of a thin film. The printing tape 22 supplied from the tape spool 23 is moved in the tape feeding direction by a tape feeding roller 24 while being guided in a curved passage by a plurality of guides, passing directly in front of the thermal head 12, and discharged out of the tape cassette 20.

Figure 2:
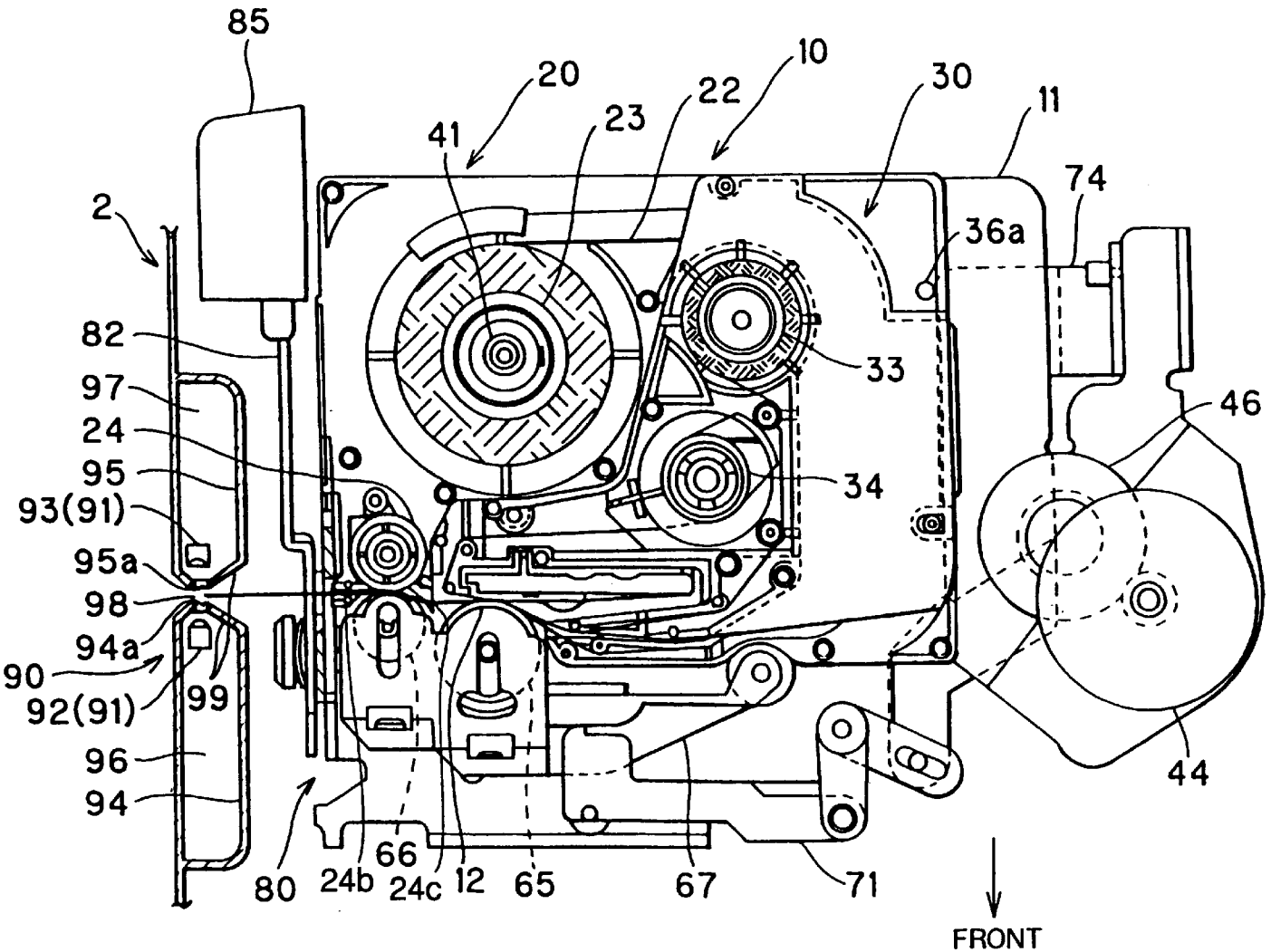
FIG. 2 is a plan view showing a thermal printing mechanism in the printing state.
Figure 3:
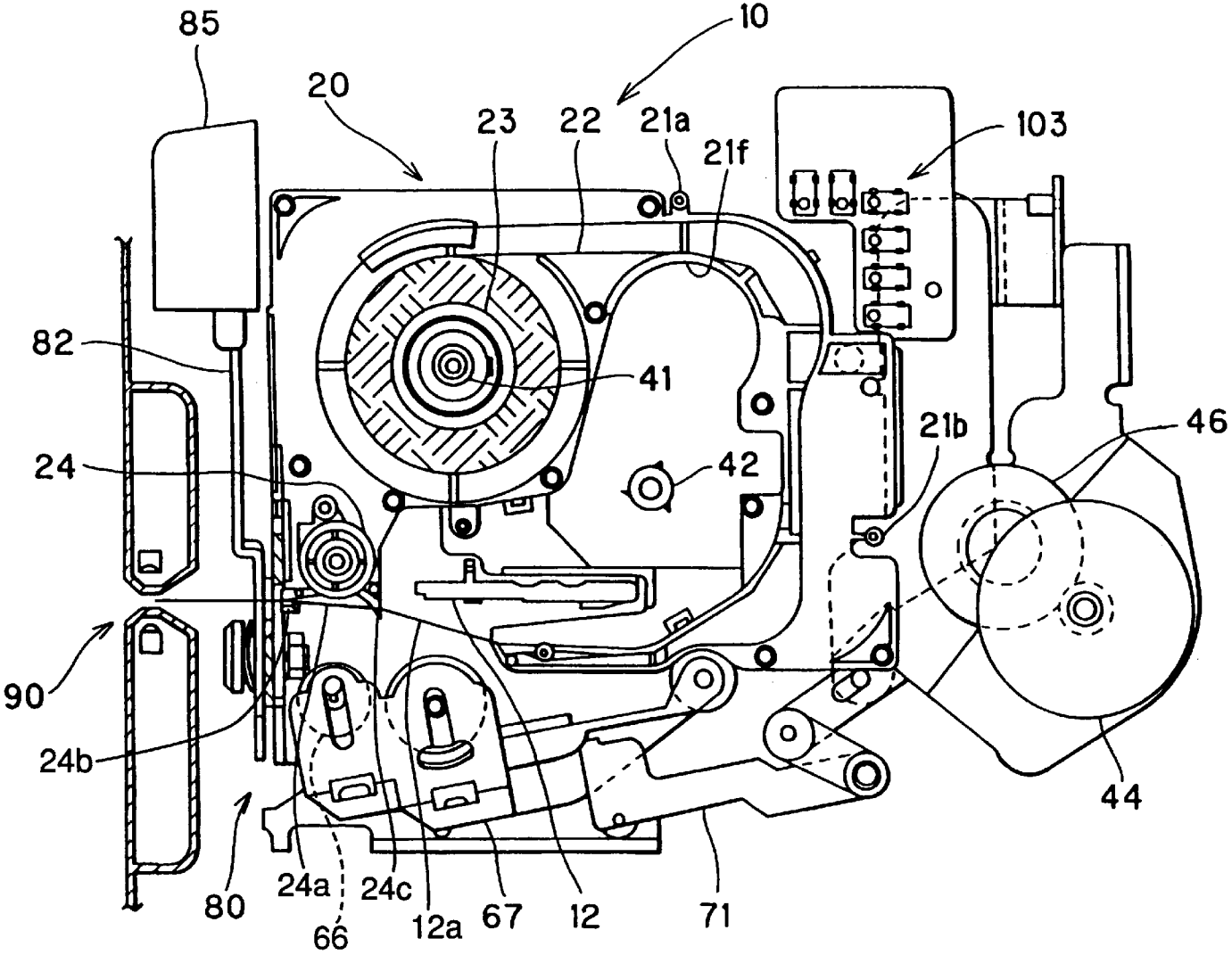
FIG. 3 is a plan view showing the thermal printing mechanism in a tape rewinding state.
Figure 4:
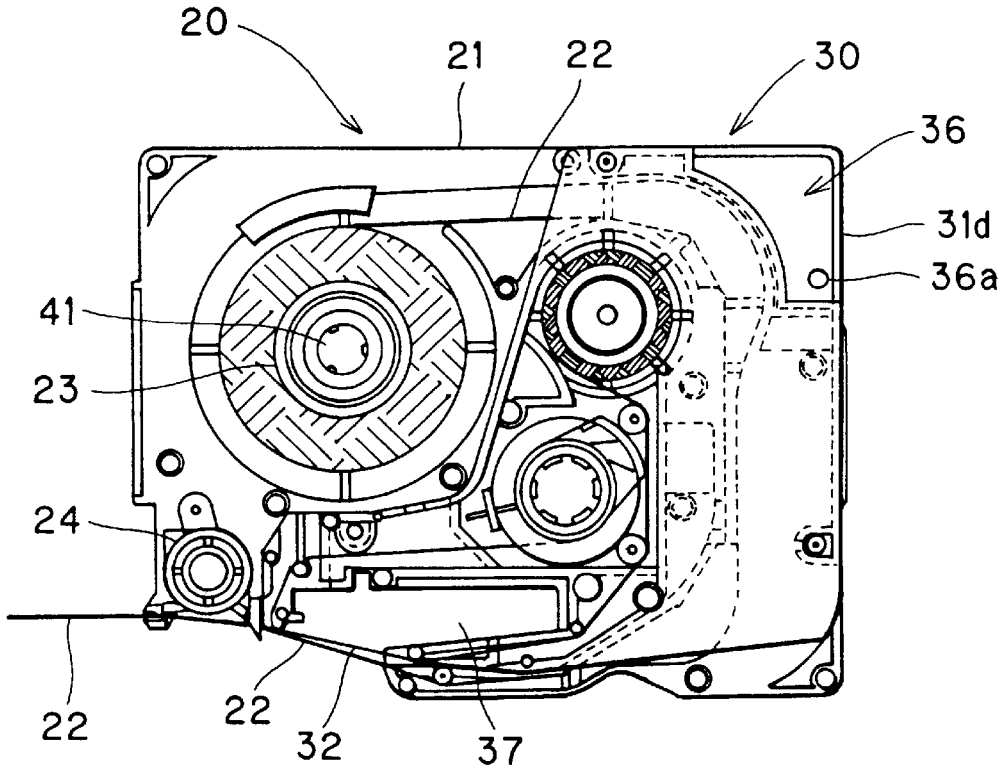
FIG. 4 is a plan view showing a tape cassette mounted with a ribbon cassette.
Figure 5:
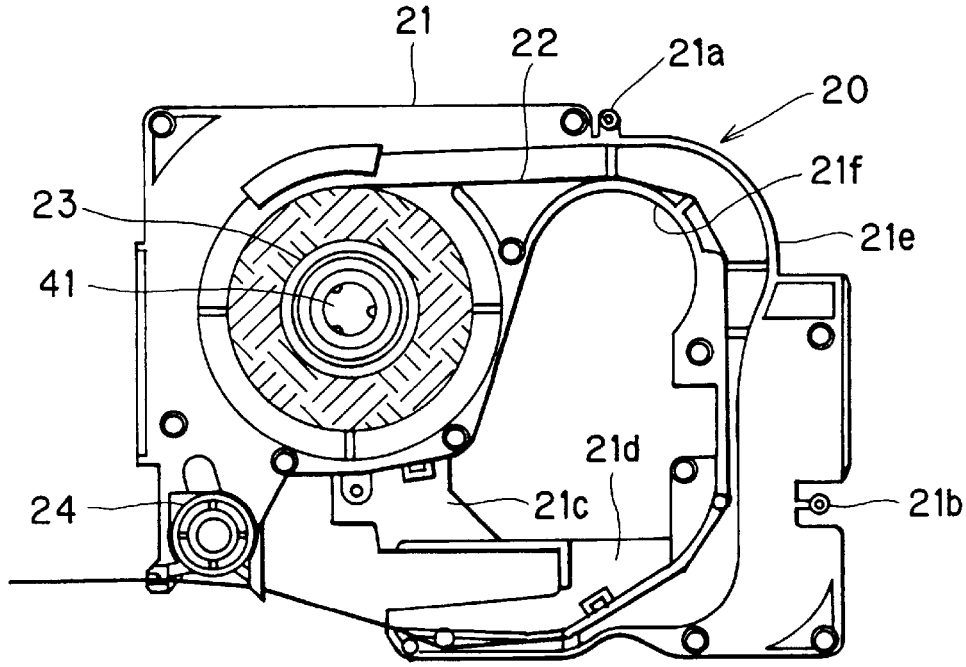
FIG. 5 is a plan view showing the tape cassette only.
Figure 6:
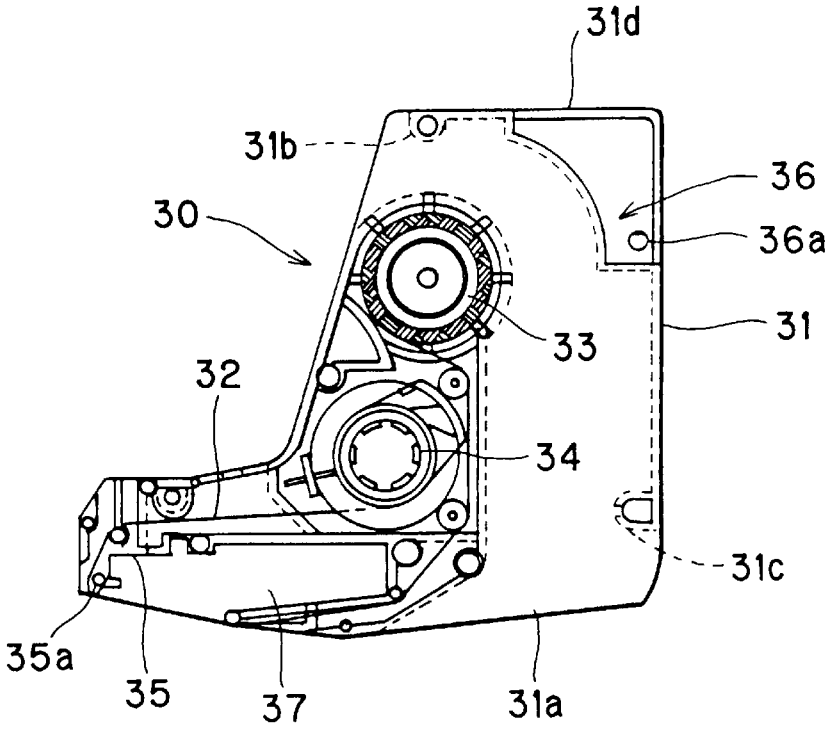
FIG. 6 is a plan view showing an internal arrangement of the ribbon cassette.
Figure 8:
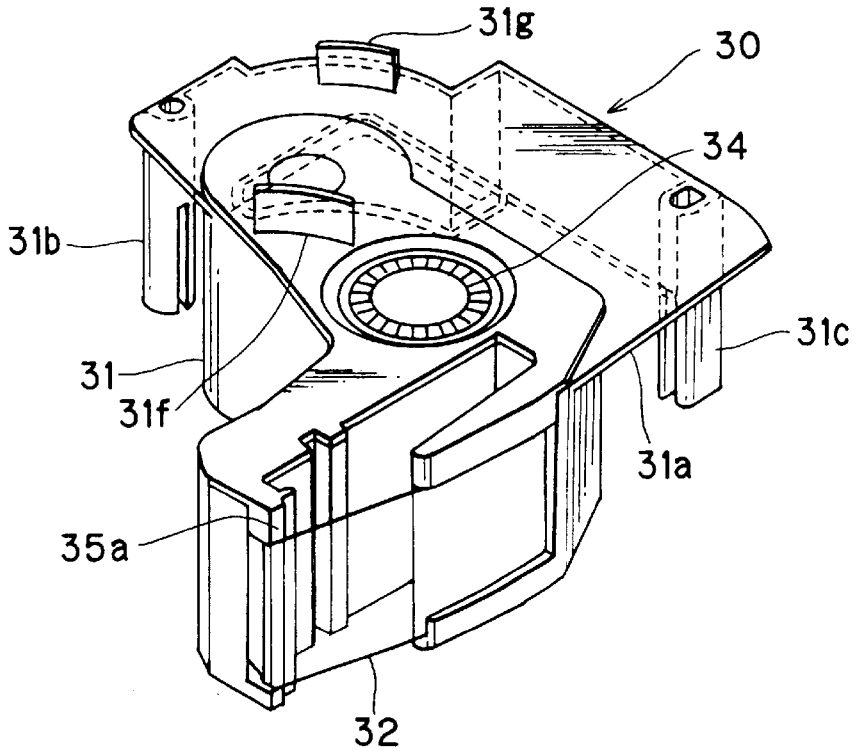
FIG. 8 is a perspective view showing the ribbon cassette.

As shown in FIGS. 2 and 3, the cassette 20 has a printing region 12A adjacent the thermal head 12, and a feed path of the tape 22 moves from the tape spool 23, across the printing region 12A to the tape feeding roller or feed capstan 24. A recess 24A is provided in the cassette 20 adjacent the feed capstan 24 and has a length along the feed path that extends on opposite sides of the feed capstan. Preferably, the recess 24A is an arcuate recess having a diameter or length in the feed path direction. The diameter or length is larger than the diameter of the feed capstan. In this way, a tape feeding subroller or drive roller 66 can be received in the recess 24A (FIG. 2) for driving the tape in a nip between the feed capstan 24 and the drive roller 66, with the drive roller 66 contacting the tape without contacting the cassette housing. In addition, first and second tape regulating members 24B and 24C are located near the ends of the recess 24A for guiding the tape across the feed capstan 24. When the drive roller 66 is received in the recess 24A, the drive roller 66 is located between the first and second tape regulating members.

Figure 7:
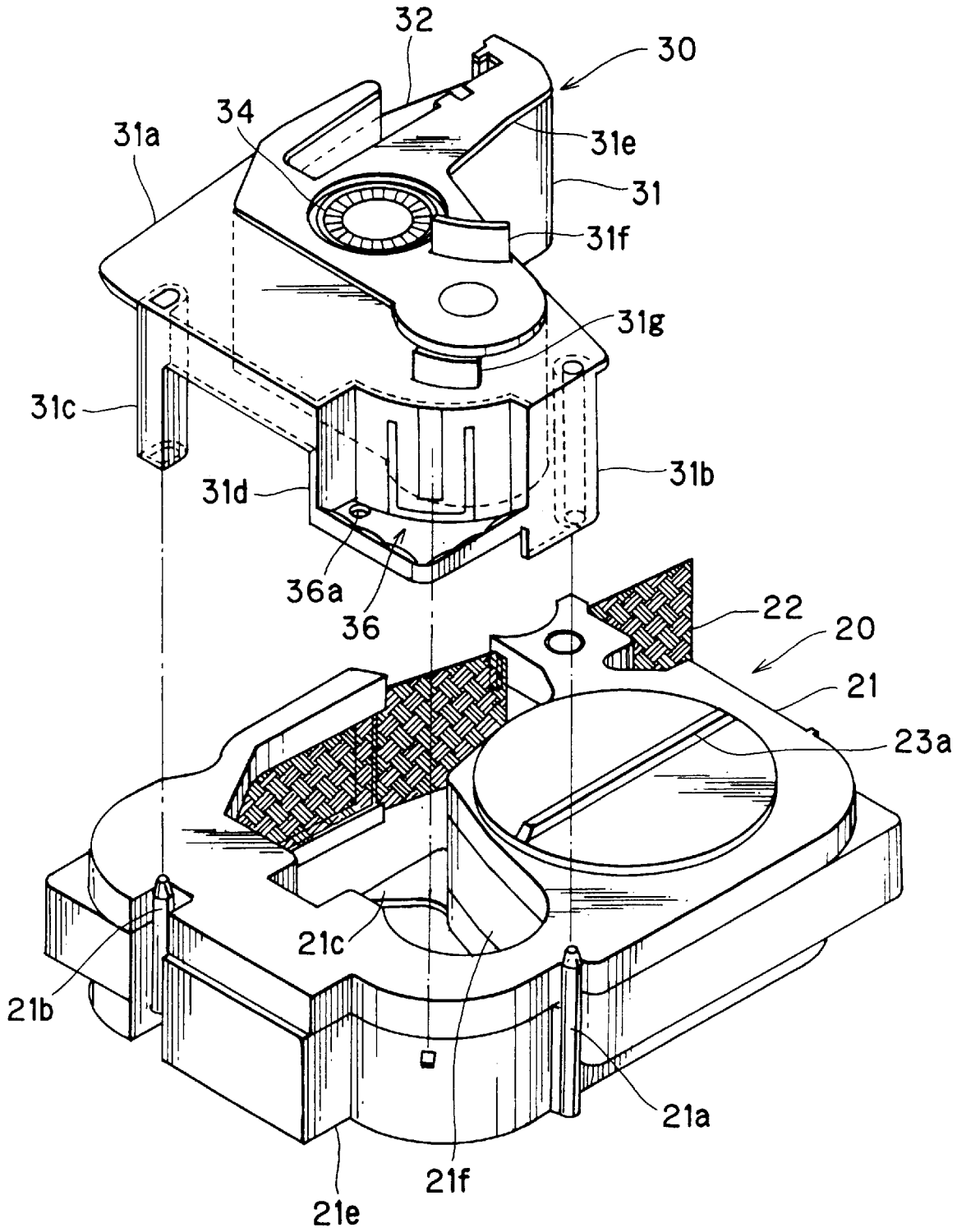
FIG. 7 is a rear perspective view showing the ribbon cassette before it is loaded into the tape cassette.

As shown in FIG. 7, a pair of guide shafts 21*a* and 21*b* are provided at positions spaced away from each other for supporting the ribbon cassette 30. Each lower end portion of the guide shaft 21*a*, 21*b* is provided integrally with an outer peripheral wall of the tape cassette 20. The ribbon cassette 30 is slidably movable in a vertical direction along the guide shafts and is supported thereby for exchanging the ribbon cassette with a new ribbon cassette. Further, a pair of lower end walls 21*c* and 21*d* are formed on the tape case 21 for supporting the lower surface of the ribbon cassette 30.

Next, the ribbon cassette 30, which is removably mounted on the tape cassette 20, will be described with reference to FIGS. 2 through 8.

The ribbon cassette 30 includes a ribbon case 31 integrally provided with an upper wall 31*a* extending horizontally and adapted to contact with the top wall of the tape case 21. A pair of engaging feet 31*b* and 31*c*, each having a through-hole running through its entire length, extend integrally from the lower surface of the upper wall 31*a* and at edge portions thereof to fit around the pair of guide shafts 21*a* and 21*b* of the tape case 21. A vertical wall 31*d* is integrally suspended from the upper wall 31*a*. The vertical wall 31*d* is in contact with a notch 21*e* on the tape case 21. A head accommodating portion 37 is formed on the ribbon cassette 30 to accommodate the thermal head 12, which is inserted from below and passed through the tape cassette 20.

In addition, the inner portion of the ribbon case 31 is rotatably provided with a ribbon spool 33 around which the ink ribbon 32 is wound, and a take-up spool 34 for taking up the ink ribbon 32. Through an ink ribbon passage provided in the ribbon cartridge 30, the ink ribbon 32 winding over the ribbon spool 33 extends in parallel with and in the vicinity of the printing tape 22 when the ink ribbon 32 is placed against the thermal head 12. The ink ribbon is bent in an approximate acute angle at the separation portion 35*a* of a separation member 35 provided integrally with the ribbon case 31. Thus the ink ribbon 32 is separated from the printing tape 22 and taken up by the ribbon take-up spool 34. The separation member 35 of the ribbon case 31 is positioned on the downstream side of the thermal head 12 in the tape feeding direction. A lid 31*e* is provided on the ribbon case 31 to support from above parts such as the ribbon spool 33, the take-up spool 34, and the separation member 35, etc.

A ribbon cassette accommodating portion 21*f* for accommodating the ribbon cassette 30 is formed in the tape case 21 as shown in FIG. 7. Tabs 31*f* and 31*g* are provided on the upper surface of the lid 31*e* and upper wall 31*a* of the ribbon case 31, respectively. When printing, the tape case 21 is first mounted in a recessed portion (not shown) formed in the main cover 2, and then, the ribbon cassette 30 having the desired color of ink ribbon 32 can be mounted in the ribbon cassette accommodating portion 21*f* of the tape case 21.

In mounting the ribbon cassette 30 in the ribbon cassette accommodating portion 21*f*, while grasping each of the tabs 31*f* and 31*g* with two fingers, the engaging legs 31*b* and 31*c* are fitted around their corresponding guide shafts 21*a* and 21*b* via the holes running through the engaging legs 31*b* and 31*c*, and the ribbon cassette 30 is moved downward so that it is received in the ribbon cassette accommodating portion 21*f*.

At this time, the upper wall 31*a* of the ribbon case 31 is resting on the top surface of the tape cassette 20, while the lower end of the ribbon cassette 30 is brought into abutment with the pair of lower end walls 21*c* and 21*d* of the tape case 21 from above, and the ribbon cassette 30 is held in a desirable position relative to the tape case 21.

A plurality of varieties of ink ribbons 32, in colors such as red, green, yellow, and black and ribbon widths such as 12, 18, 24, and 32 mm, are prepared for the ribbon cassette 30. A group of detection holes 36 made up of a maximum of six detection holes 36*a* (the ribbon cassette of FIG. 6 only shows one detection hole 36*a*) is formed on a lower horizontal end portion of the vertical wall 31*d* on the ribbon case 31. These are allowing detection of any one of the plurality of varieties of ribbon cassettes 30.

Next, a tape/ribbon transfer mechanism 40 will be described with reference to FIG. 9. The tape/ribbon transfer mechanism 40 can move the printing tape 22 and the ink ribbon 32 in the feeding direction, i.e., the printing direction, and in the rewinding direction, i.e., the direction opposite to the printing direction.

Supported rotatably on the main frame 11 are a tape take-up cam 41 engageable with the center portion of the tape spool 23, a ribbon take-up cam 42 engageable with the center portion of the ribbon take-up spool 34, and a tape drive cam 43 engageable with the center portion of the tape feed roller 24. The main frame 11 is provided with the thermal head 12, and also with a group of ribbon detection switches 103, including detection switches No. 1 through No. 6, for detecting the existence of the six detection holes 36*a* in the previously mentioned group of detection holes 36. The ribbon detection signal RS is output according to the combination of switch signals from these six detection switches. The cassette detector is thus constructed by the group of ribbon detection switches 103 and the group of detection holes 36.

Further, a tape drive motor 44 such as a stepper motor is installed on the right front end portion of the main frame 11. Gears 46 through 53, each rotatably supported on the main frame 11 are interlocked sequentially with a drive gear 45 of the tape drive motor 44. A gear 55 and a tape drive gear 54 coupled to the tape drive cam 43 are meshedly engaged with the gear 53. Among these gears, gears 48 and 49 are provided integrally and are fixed to the lower end portion of the ribbon take-up cam 42. Gears 50 and 51 are provided integrally. Additionally, tape take-up gear 52 is fixed to the lower end portion of the tape take-up cam 41. Thus, the rotation of the tape drive motor 44 is transmitted to the tape drive cam 43 fixed to the tape drive gear 54 via the gears 45 through 54. Accordingly, the printing tape 22 is moved by the rotation of the tape feed roller 24.

A swing lever 56 is provided. The swing lever 56 has a base portion supported in a space between the integral gears 50 and 51. An appropriate amount of frictional resistance is provided between the swing lever 56 and the two gears. The swing lever 56 is rotatably provided with a planet gear 57 continuously engaged with the gear 51. The gear 53 has a rotation shaft 58 to which a base end portion of a cut-restricting lever 84 is urgedly supported. That is, the cut-restricting lever 84 supports thereon a torsion spring 59, and one end of the torsion spring and the base end of the lever 84 interpose therebetween the shaft 58, so that the base end of the cut restricting lever 84 is urgedly pressed against the shaft 58 by the biasing force of the torsion spring 59.

Figure 9:
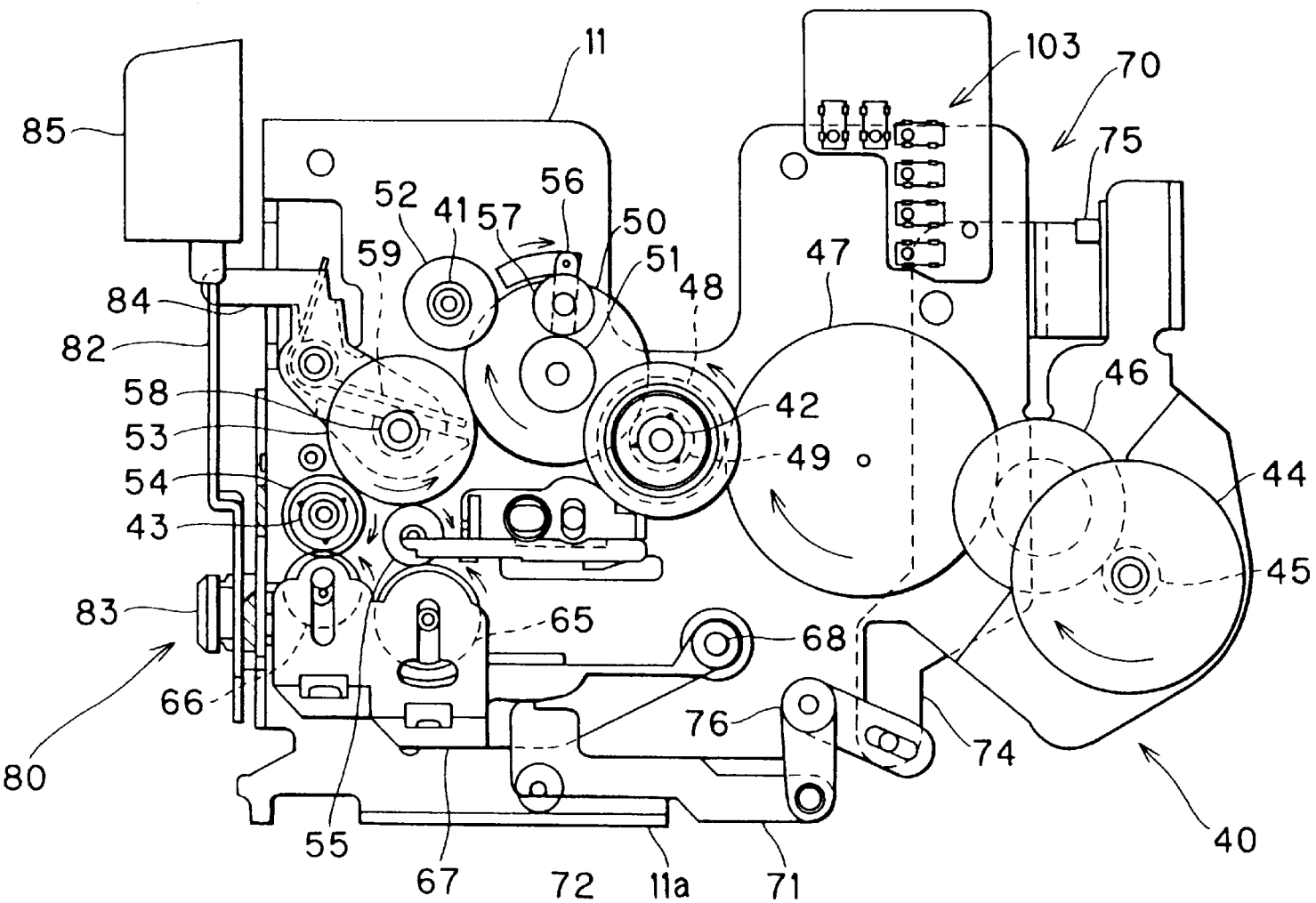
FIG. 9 is a plan view showing a drive system of the thermal printing mechanism in the printing state.
Figure 10:
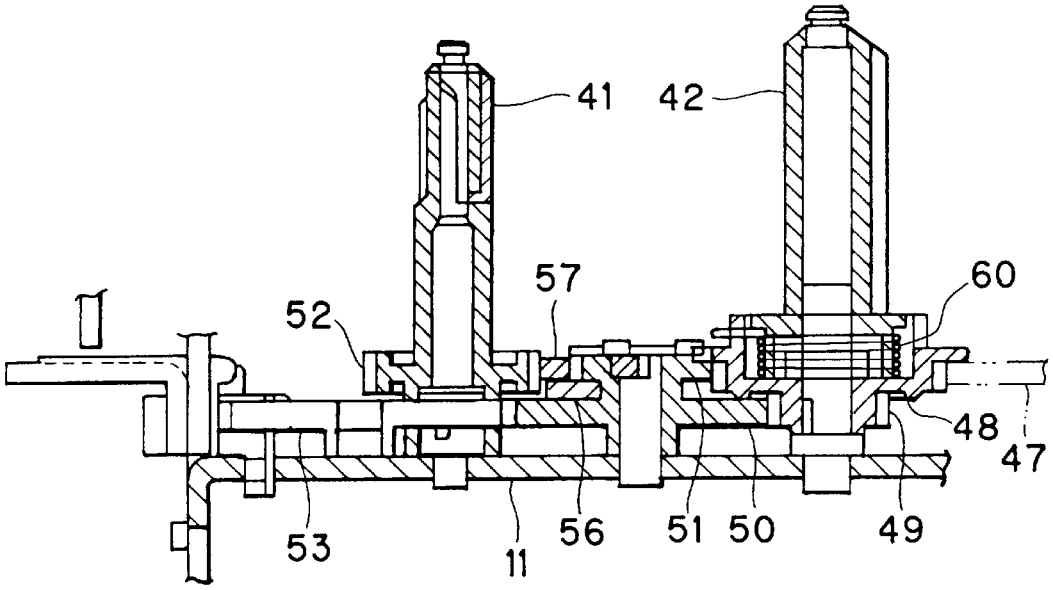
FIG. 10 is a vertical cross-sectional front view showing a gear engaging relation of essential portions in the thermal printing mechanism.

As shown in FIG. 9, when the tape drive motor 44 is driven in the clockwise direction for normal printing operation, the gear 50 rotates in the clockwise direction. In this case, the swing lever 56 is pivoted in the clockwise direction about an axis of the gear 51 because of the frictional force between the gears 51 and 57. Consequently, the planet gear 57 is disengaged from the tape take-up gear 52 to render the tape take-up cam 41 free. Accordingly, the printing tape 22 wound around the tape spool 23 can be paid out, because no take-up force is imparted to the take-up cam 41. At the same time, the gear 53 is rotated in the counterclockwise direction, so that the cut restricting lever 84 is pivoted about an axis of the shaft 53 in the counterclockwise direction. Consequently, the end portion of the cut restricting lever 84 is brought into a position immediately below a cutting lever 82 described later, thus restricting cutting operations. At the same time, because of the rotation in the counterclockwise direction of the ribbon drive gear 48, the ribbon take-up cam 42 is also rotated in the counterclockwise direction, via a clutch spring 60. Therefore, the ink ribbon 32 is taken up by the ribbon take-up spool 34.

A roller holder 67 for rotatably supporting a rubber platen roller 65 and a rubber tape feeding subroller 66 is pivotably supported on the main frame 11 by a pivot shaft 68. A release lever 71 is provided movable leftward and rightward and is interlocked with the opening and closing motion of the cassette cover 3. The release lever 71 changes its position between a printing position shown in FIG. 9 and a release position shown in FIG. 11.

The roller holder 67 is normally biased toward its release position by a spring (not shown in the drawings). A wheel roller 72 rotatably attached to the release lever 71 is in contact with an upstanding wall 11*a* of the main frame 11. At the same time, a free end of the release lever 71 is in contact with the roller holder 67 from the rear side. Therefore, when the release lever 71 is moved leftward from the release position shown in FIG. 11 to the operating position shown in FIG. 9, the left end of the release lever 71 is wedged between the roller holder 67 and the upstanding wall 11*a*, so that the roller holder 67 is changed from its release position to its printing position.

At this time, the platen roller 65 presses against the thermal head 12 through the printing tape 22 and the ink ribbon 32, and the tape feeding subroller 66 presses against the tape feeding roller 24 through the printing tape 22.

When the roller holder 67 is changed to the printing position, a platen gear (not shown in the drawings) fixed to the lower end portion of the platen roller 65 is brought into meshing engagement with the gear 55, and a subroller gear (also not shown) fixed to the lower end portion of the tape feeding subroller 66 is brought into meshing engagement with the tape drive gear 54.

Next, a head release mechanism 70 will be described with reference to FIG. 9 and FIGS. 11 through 13. The head release mechanism is adapted for moving the roller holder 67 to its release position with respect to the thermal head 12 by moving the release lever 71 rightwardly in accordance with the opening movement of the cassette cover 3.

Figure 12:
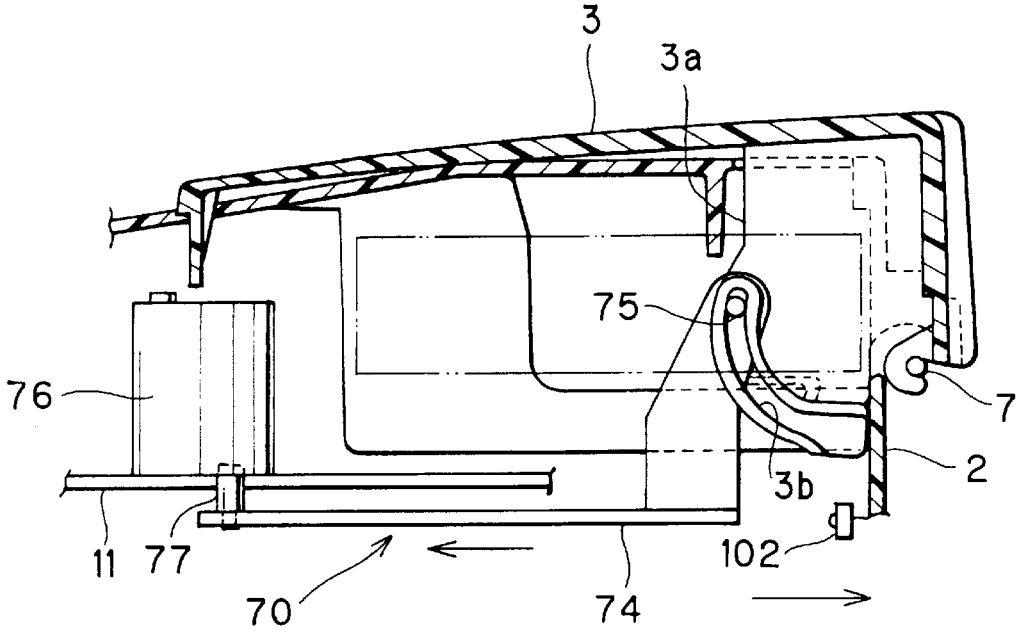
FIG. 12 is a vertical cross-sectional side view showing essential portions when the cassette cover is closed.
Figure 13:
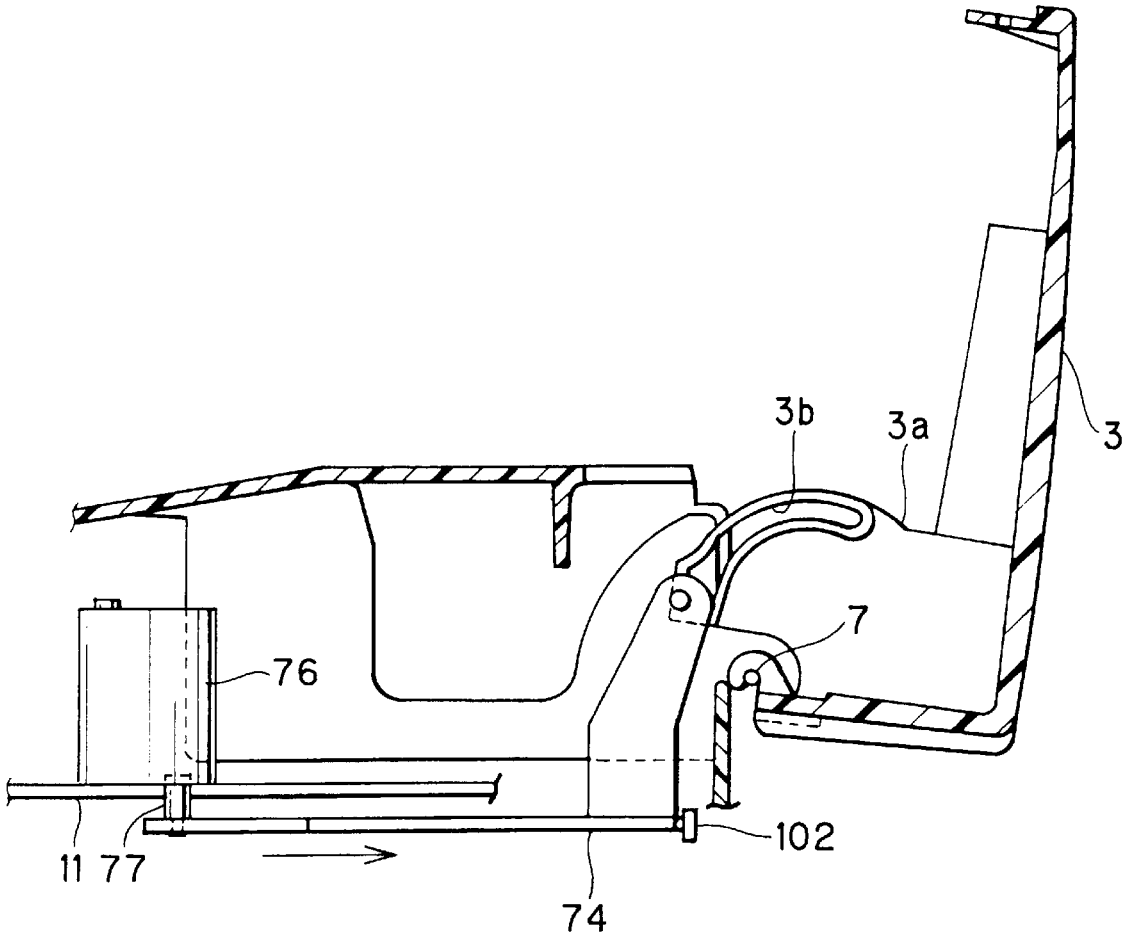
FIG. 13 is a vertical cross-sectional side view showing the essential portions when the cassette cover is open.

As shown in FIGS. 12 and 13, the rear portion of the cassette cover 3 is supported in a plurality of places by the pivotal pin 7 attached on the main cover 2 so that the cassette cover 3 can open and close. A curved, grooved cam 3*b* is formed on the right side wall 3*a* of the cassette cover 3. An operation plate 74 is positioned on the right, underside of the main frame 11, and an engaging pin 75 engageable with the grooved cam 3*b* is fixed to the rear end portion of the operation plate 74. The right end portion of the release lever 71 is pivotally supported on one arm of a forked lever 76. The forked lever 76 has the other arm connected to the operation plate 74 via a pin 77 fixed to the front end portion of the operation plate 74.

In a state where the cassette cover 3 is closed as shown in FIG. 12, in other words in a state where the roller holder 67 is in the printing position shown in FIG. 9, if the cassette cover 3 is then opened as shown in FIG. 13, the engaging pin 75 engaged with the grooved cam 3*b* is moved rearwardly by the movement of this grooved cam 3*b*. Therefore, the operation plate 74 is moved rearward, and the forked lever 76 is pivoted in the counterclockwise direction. As a result, the roller holder 67 is moved rightward so that the roller holder 67 is changed to the release position. When the operation plate 74 is moved rearward, a cover open and close signal VS of "H" level is output from a cover open and close detection switch 102.

Figure 11:
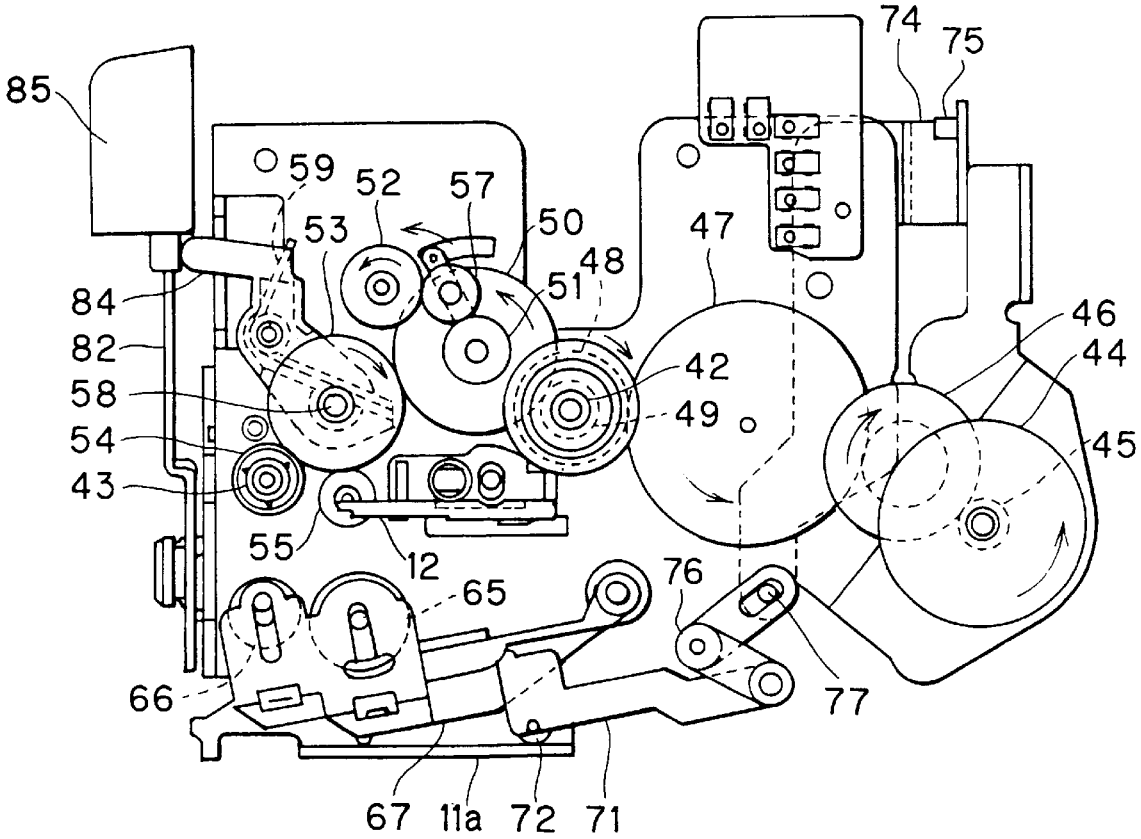
FIG. 11 is a plan view showing the drive system of the thermal printing mechanism in the tape rewinding state.

Further, when the cassette cover 3 is in the open position shown in FIG. 13, in other words when the roller holder 67 is in the release position shown in FIG. 11, and the cassette cover 3 is then closed, as shown in FIG. 12, the engaging pin 75 is moved frontward by the movement of the grooved cam 3*b*. Therefore, the operation plate 74 is moved frontward, and the forked lever 76 is pivoted in the clockwise direction from the position shown in FIG. 11. The roller holder 67 is changed to the printing position, or non-release condition, in response to the movement of the release lever 71 leftward.

As shown in FIGS. 2 and 9, for performing printing operation, the tape cassette 20 is first mounted on the thermal printing mechanism 10. Then, the ribbon cassette 30 is mounted on the tape cassette 20. When the cassette cover 3 is closed, the roller holder 67 is shifted to the printing position.

From this position, when the tape drive motor 44 is driven in its normal printing direction, i.e., in the clockwise direction, each of the gears 45 through 55 is driven to rotate in its prescribed direction. The platen roller 65 and the tape feeding subroller 66 are each rotated in the counterclockwise direction. Further, because the tape feeding subroller 66 and the tape feeding roller 24 are in synchronous rotation, the tape passes by the tape cutting mechanism 80 and the tape detection mechanism 90 and is discharged outside, while the printing tape 22 is being printed on by the thermal head 12. During this time, the tape take-up cam 41 is free, and, therefore, the printing tape wound over the tape spool 23 is continually supplied with no resistance.

At the same time, and at the same pace as the printing tape 22, the ink ribbon 32 is supplied from the ribbon spool 33 by the rotating motion of the platen roller 65. The ink ribbon 32 is then taken up by the ribbon take-up spool 34 engaged with the ribbon take-up cam 42, which is rotated by the ribbon take-up gear 48.

After the printing of the first color is completed and the second color is to be printed, the cassette cover 3 is released. When the ribbon cassette 30 is removed, the roller holder 67 is changed to the release position by the head release mechanism 70. Then, when the tape drive motor 44 is driven to rotate in the counterclockwise direction, (the tape rewinding direction), each of the gears 45 through 55 is driven to rotate in its prescribed direction, as shown in FIGS. 3 and 11. As a result of the gear 50 rotating in the counterclockwise direction, the swinging lever 56 is also pivoted in the counterclockwise direction to bring the planet gear 57 into meshing engagement with the tape take-up gear 52. Accordingly, the tape take-up cam 41 is rotated in the counterclockwise direction. Thus, the printing tape 22 that has been printed on once is taken up by the tape spool 23. At this phase, the ribbon take-up gear 48 is driven in the clockwise direction. However, the ribbon cassette 30 has been removed, and, thus, the ink ribbon 32 taken up by the ribbon take-up spool 34 is not supplied.

Figure 14:
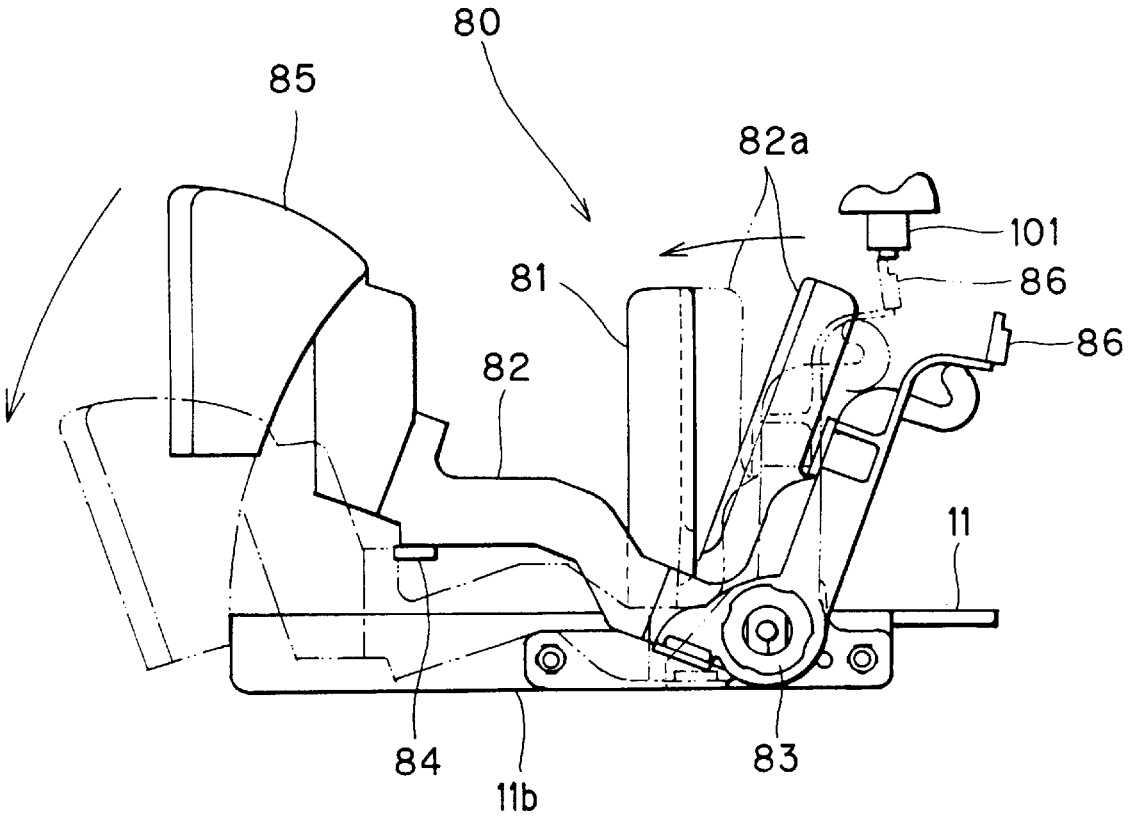
FIG. 14 is a side view showing a tape cutting mechanism of the thermal printing mechanism.

Next, a tape cutting mechanism 80 for cutting the printing tape 22 that has been printed on will be described with reference to FIGS. 14 and 15.

The main frame 11 has a left end wall 11*b* provided by partially bending downwardly the left end portion of the frame 11, and a lower end of a fixed blade 81 fixed to the left end wall 11*b*. A cutting lever 82, which, from the side view, looks like an abbreviated L shape, has a base end portion pivotally supported by a screw 83 to the left end wall 11*b*. A movable blade 82*a* is formed on the cutting lever 82. As shown in FIG. 9, during the printing process, gear 53 rotates in the counterclockwise direction, moving the end portion of the cut restricting lever 84 to the under side of the cutting lever 82 and, thus, restricting the cutting operation.

Figure 15:
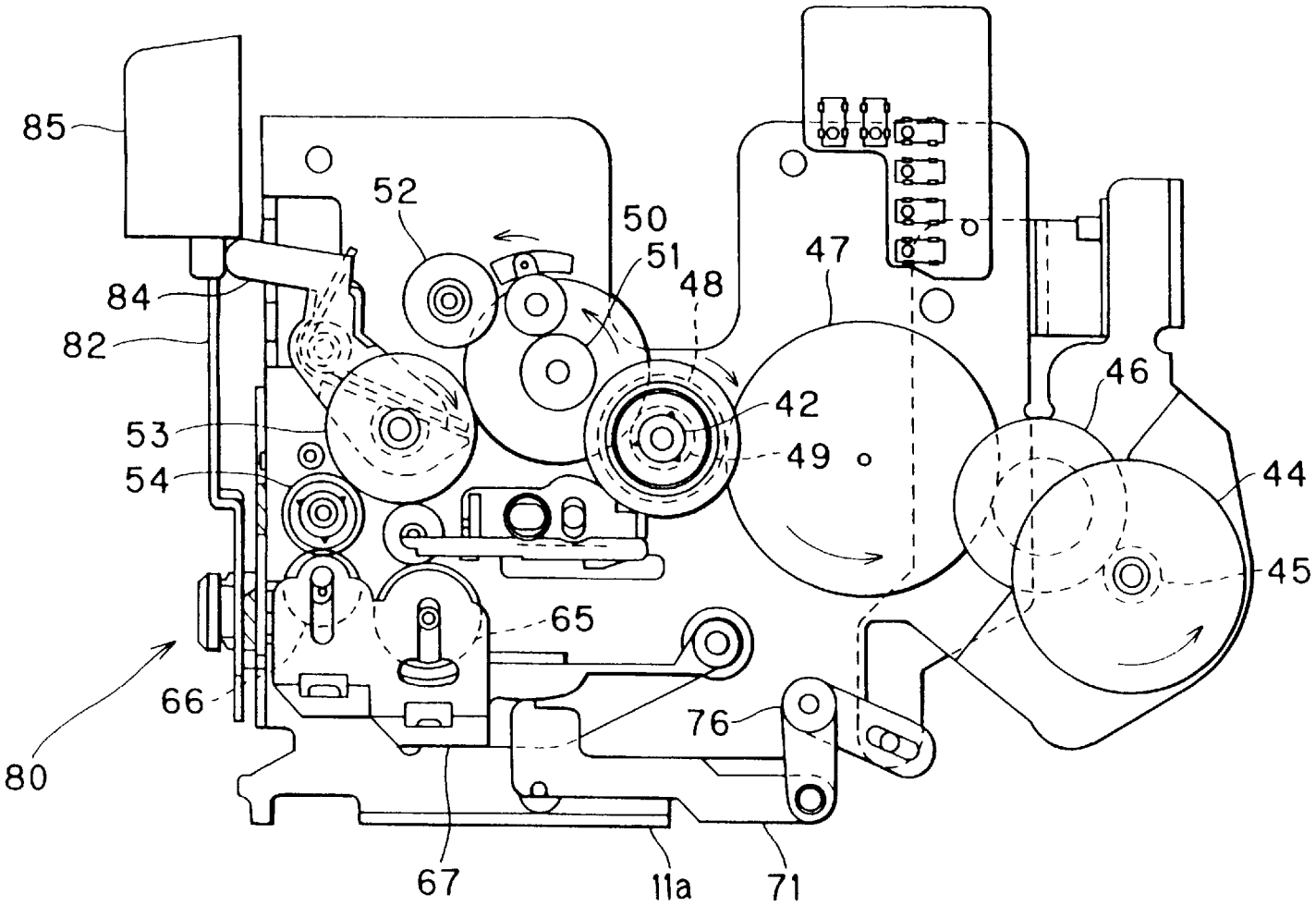
FIG. 15 is a plan view showing the drive system of the thermal printing mechanism in a tape cutting permission state.

However, when printing is completed and the tape drive motor 44 is rotated only slightly in the rewinding direction, gear 53 is rotated slightly in the clockwise direction as shown in FIG. 15, displacing the end portion of the cut restricting lever 84 from underneath the cutting lever 82 to allow cutting operations. When the cutting button 85 on the end portion of the cutting lever 82 is pushed downward as shown in FIG. 14, the movable blade 82*a* is pivoted to the cutting position indicated by a two dotted chain line. The printing tape 22 positioned between the fixed blade 81 and the movable blade 82*a* is cut through the force of these two blades. A cutting detection switch 101 installed on the main frame 11 is operated by an operation member 86 installed on the cutting lever 82 and outputs a cutting detection signal CS. After releasing pressure on the cutting lever 82, the cutting lever 82 is pivoted back to its original prescribed position indicated by the solid line, by urging force of a spring (not shown).

Next, a tape detection mechanism 90, which is provided on the outer side of the tape cutting mechanism 80 to detect the existence of the printing tape 22, will be described with reference to FIG. 2.

Guiding members 94 and 95 are provided integral with the main cover 2 at a position outside the tape cutting mechanism 90. The guiding members 94 and 95 are designed to form a tightly sealed pair of sensor accommodating chambers 96 and 97. A light emitting element 92 is installed in the sensor accommodating chamber 96. A light receiving element 93 is installed in the sensor accommodating chamber 97. A slit 98 is formed between the pair of guiding members 94 and 95 to allow the printing tape 22 to pass therethrough. Light transmitting holes 94*a* and 95*b* having a small diameter are formed in the guide members 94, 95 in a confronting relation to each other. The slanted guides 99 are also formed at these confronting portions. The leading end of the printing tape 22 passing through the tape cutting mechanism 80 will reliably pass through this slit, because of the formation of the guides 99, so that the printing tape 22 can be accurately detected.

At this point, the sensor light emitted from the light emitting element 92 passes through the light transmitting holes 94*a* and 94*b* formed in the sensor accommodating chambers 96 and 97, and is received on the light receiving element 93. Therefore, when the printing tape 22 proceeds into the tape detection sensor 91, and the printing tape 22 is positioned between the light emitting element 92 and the light receiving element 93, the sensor's light is interrupted by the printing tape. Thus, the tape detection sensor 91 outputs an "L" level tape detection signal TS.

Figure 16:
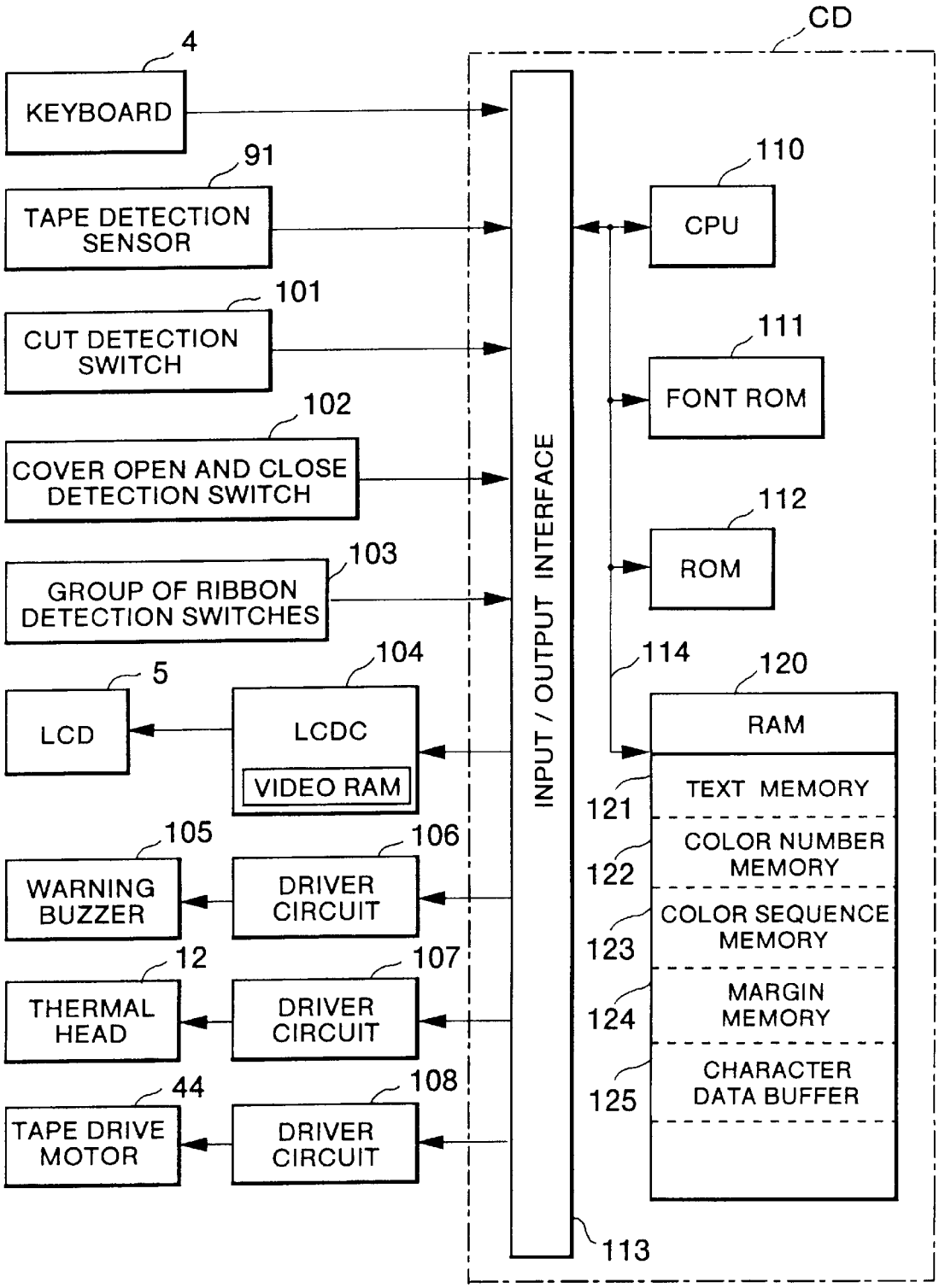
FIG. 16 is a block diagram showing a control system of the tape-shaped label printing device.
Figure 17:
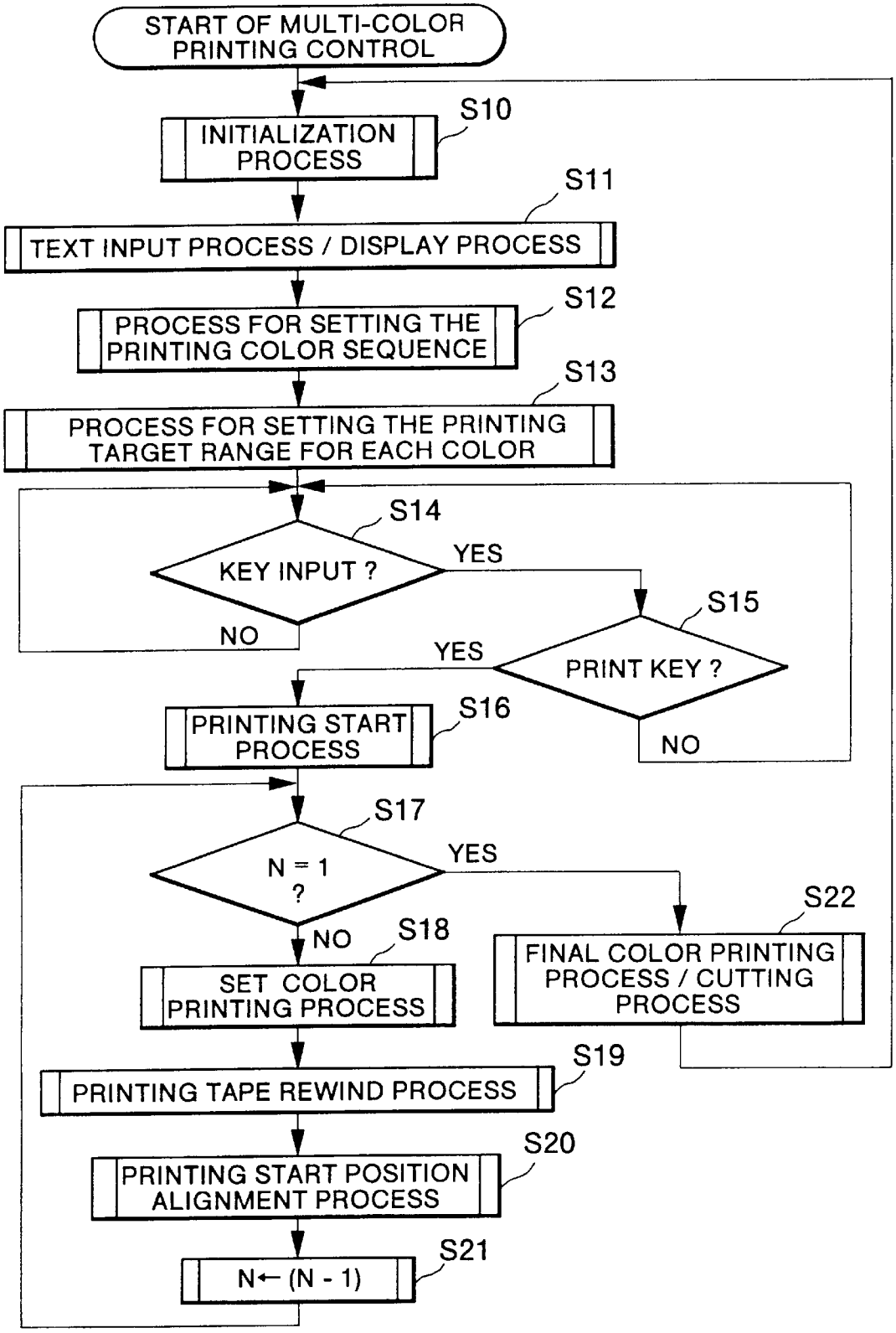
FIG. 17 is a general flowchart representing a multi-color printing control routine.

The control system of the tape-shaped label printing device 1 is configured as shown in the block diagram of FIG. 16.

Connected to an input/output interface 113 of a control device CD are the keyboard 4, the tape detection sensor 91, the cutting detection switch 101, the cover open and close detection switch 102, the group of ribbon detection switches 103, a display controller (LCDC) containing a video RAM for outputting display data to the liquid crystal display (LCD) 5, a driver circuit 106 for a warning buzzer 105, a driver circuit 107 for driving the thermal head 12, and a driver circuit 108 for the tape drive motor 44.

The control device CD includes a CPU 110, the input/output interface 113 connected to the CPU 110 via buses 114 including a data bus, a font ROM 111, a ROM 112, and a RAM 120.

The font ROM 111 stores dot pattern data for display, concerning all of the numerous characters, such as the alphabetic characters and symbols, and dot pattern data for printing in a plurality of printing character sizes.

The ROM 112 stores a display drive control program for controlling the display controller 104 to respond to the code data of alphabetic characters, symbols, numbers, and other characters input from the keyboard 4, a printing control program to create dot pattern data, for printing, the characters, symbols, and the like stored in a text memory 121; a printing drive control program for outputting the created dot pattern data for each row of dots in sequence to the thermal head 12, the tape drive motor 44, and the like for printing; and a control program (to be described later) for controlling printing of multiple colors. Incidentally, the ROM 112 stores a ribbon cassette detection table for detecting the color and width of the ink ribbon 32, based on the ribbon detection signal RS output from the group of ribbon detection switches 103, including detection switches Nos. 1 through 6.

The text memory 121 of the RAM 120 stores text data, such as alphabetic characters and symbols, input from the keyboard 4, in correspondence with the data for the printing color selected. A color number memory 122 stores data of the number of printing colors inputted. A printing color sequence memory 123 stores data of the printing color sequence selected. A margin memory 124 stores data of the size of the margin selected, where the front or top margin and rear or bottom margin are identical to each other. A printing data buffer 125 stores the developed dot pattern data corresponding to the character codes stored in the text memory 121. Further, the RAM 120 is provided with a memory for temporarily storing such data as the results of computations by the CPU 110.

Next, multi-color printing control routines carried out in the control device CD of the tape-shaped label printing device 1 will be described with reference to flowcharts of FIGS. 17 through 25. Incidentally, the symbols Si (i=10, 11, 12 . . . ) in the flowcharts indicate steps.

Figures 26, 27:
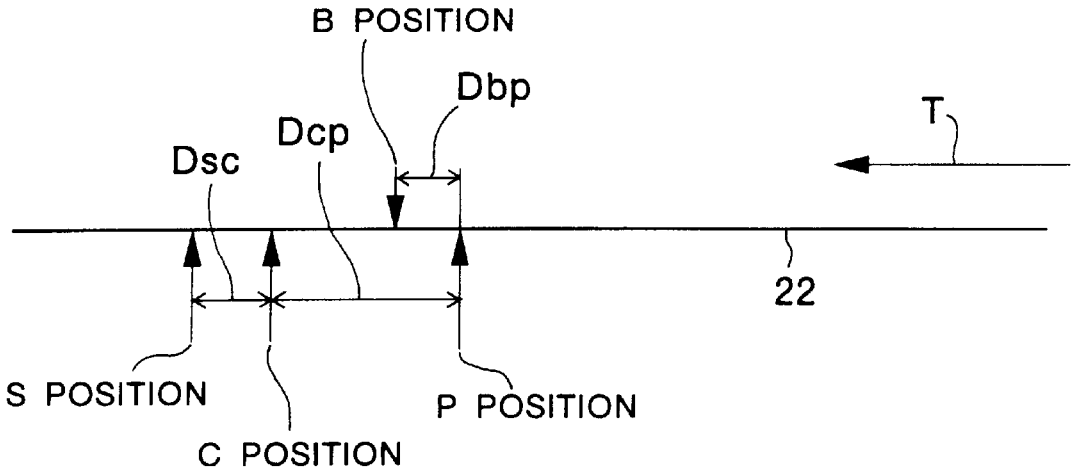
FIG. 26 is an explanatory diagram showing the positioning relationship between a printing position (P position), a tape cutting position (C position), and a tape detection position (S position)
FIG. 27 is an explanatory diagram showing the data configuration of color settings in the text memory.

Before entering into a substantive description as to the multi-color printing control, an explanation will be given based on FIG. 26, which shows the position of tape detection by the tape detection sensor 91, the position of tape cutting by the tape cutting mechanism 80, and the position of printing by the thermal head 12. Using the feeding direction T of the printing tape 22 and beginning on the upstream side, the positioning order is then the printing position (P position), the tape cutting position (C position), and the tape detection position (S position). The distance (print-cut distance) between the printing position and the tape cutting position, or Dcp, is about 25 mm. The distance (cut-detection distance) between the tape cutting position and the tape detection position, or Dsc, is about 15 mm. Further, the separation position (B position), according to the separation portion 35*a* of the separation member 35, is about 6 mm downstream from the printing position in the feeding direction T.

When electrical power is supplied into the tape-shaped label printing device 1, first an initialization process is performed to initialize such devices as the thermal printing mechanism 10 and the control device CD (S10). Then, the text input screen is displayed on the display 5. After setting printing styles, processes such as the input process for inputting text data and the display process for displaying the input text are carried out. The input text data is stored in the text memory 121 (S11). For example, as shown in FIG. 27 input text data of "AB" "CDE" and "FG" are stored in the text memory 121.

Figure 18:
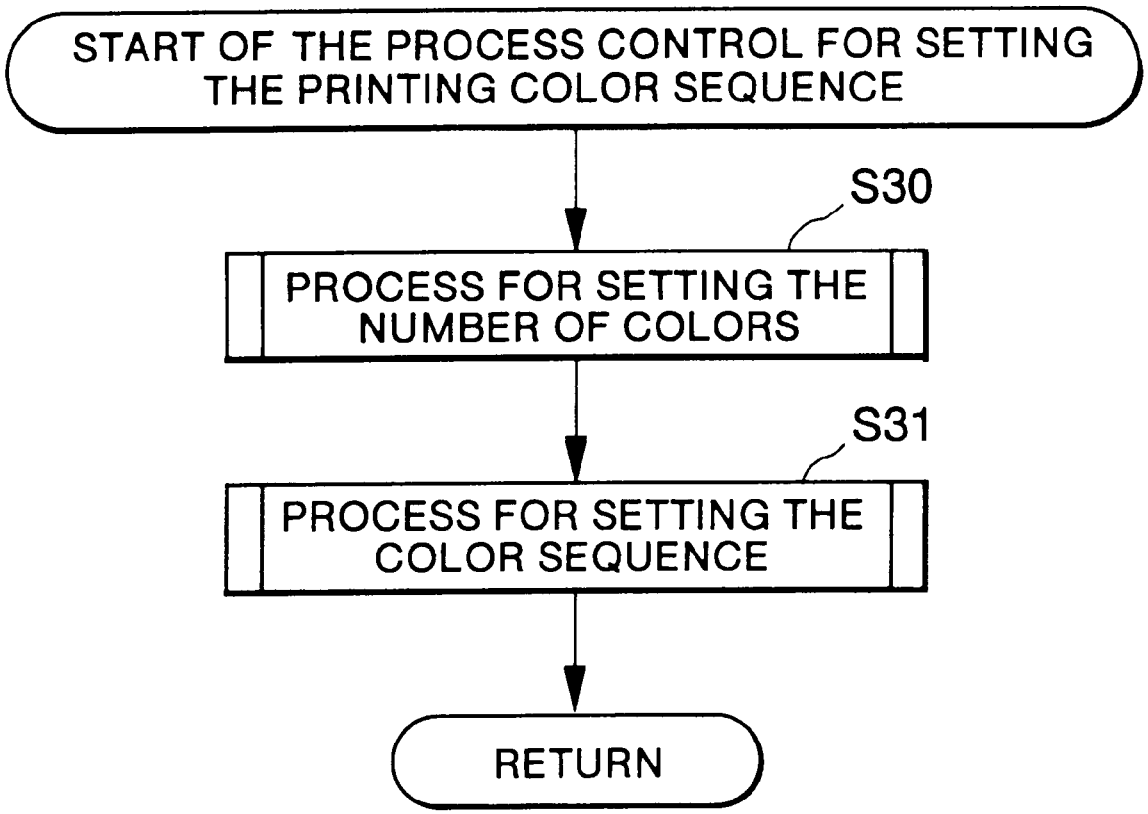
FIG. 18 is a flowchart representing a process control for setting the printing color sequence.

Next, the process control for setting the printing color sequence (S12) shown in FIG. 18 is executed.

When this control begins, the message "Number of colors?" is displayed on the display 5, and the process for setting the number of colors is executed to set the number N of colors by using the numeric keys. The number N of colors set is stored in the color number memory 122 (S30). Next, the names of the plurality of colors are displayed on the display 5. Therefore, a color order setting process for serially setting order of colors to be printed is executed and the data of color order set in this manner is stored in the print color order memory 123 in S31. This ends this routine and the multi-color print program returns to S13.

Figure 19:
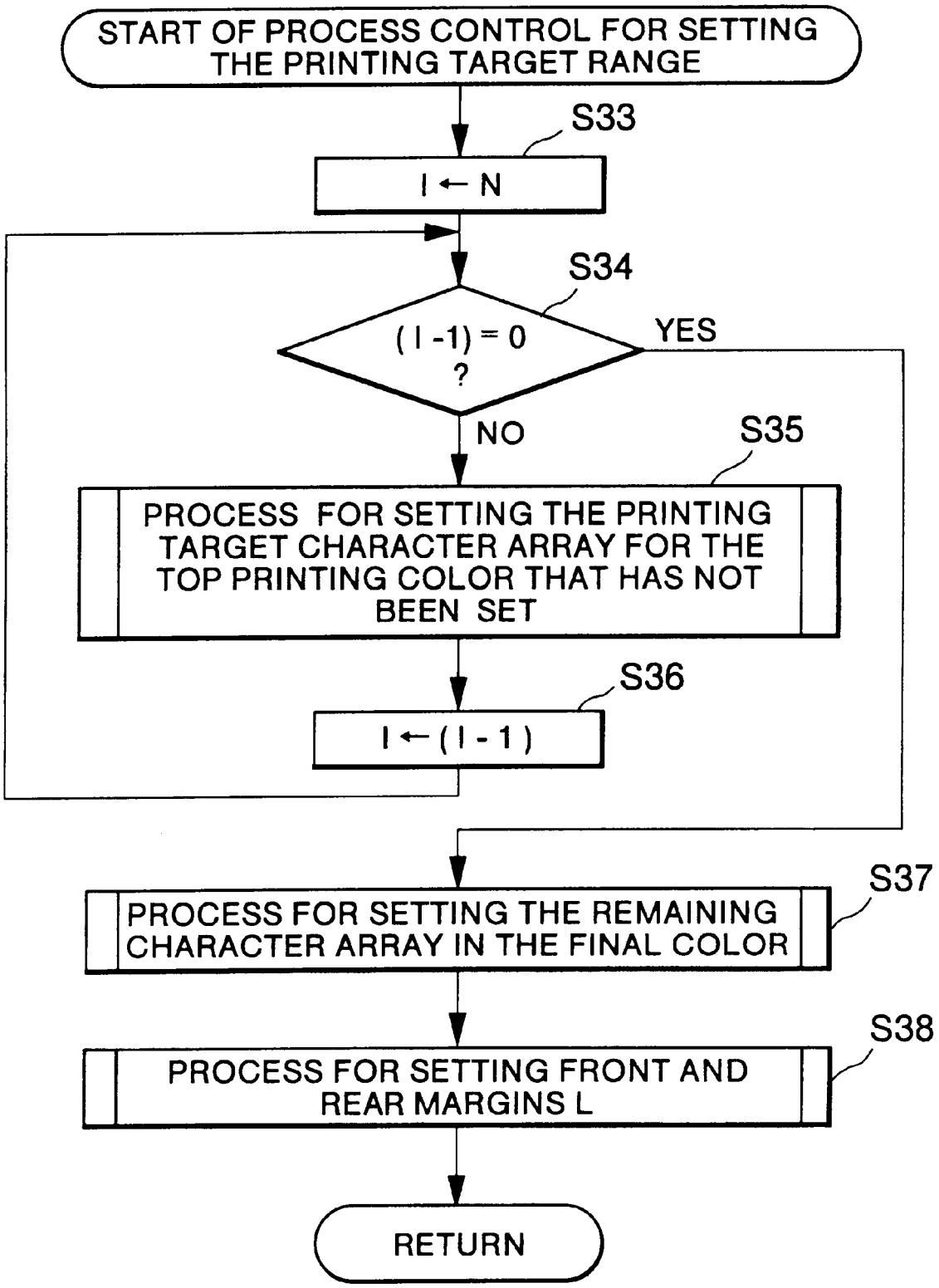
FIG. 19 is a flowchart representing a process control for setting a printing target range for each color.

Next, in the multi-color printing control, the process control for setting the printing range of each color is executed in step S13 as shown in FIG. 19.

When this control begins, the color number N is set in a color number counter as a count value I (S33). Then, subtraction of "1" from the color number count value I is executed and if the answer is not zero, that is, if the character array is not the final target character array in connection with the final color (S34:NO), then the process for setting the printing target character array is executed in S35 for the leading printing color in the printing color sequence among colors which have not been set. This setting is performed based on the color order data by indicating, with a cursor, the characters, symbols and the like constituting the target character array in connection with the subsequent color.

That is, during this process for setting the printing target character array, the text data is displayed in the display 5. Therefore, by operating the four cursor movement keys provided on the right side of the keyboard 4, each character, symbol and the like in the printing target array is indicated with the cursor with respect to the printing colors, except for the last printing color. Each time the character color setting is made by the cursor, a color set key is pressed. After completing setting of the printing target character arrays, a set key is pressed. By pressing this set key, the set color data is appended to the character data of the characters indicated by operating the cursor movement keys and pressing the color set key, and this data is stored in the text memory 121.

Then, the color number count value I is decremented by one (S36), and steps S34 through S36 are repeated until (I−1) equals zero. When (I−1) equals zero, that is, when the setting of the printing target character array with respect to all of the printing colors except the last color have been completed (S34:YES), a process for setting the character array is executed in S37 in order to set the remaining characters and symbols in the text data that have not already been set in connection with the last printing color.

Figure 20:
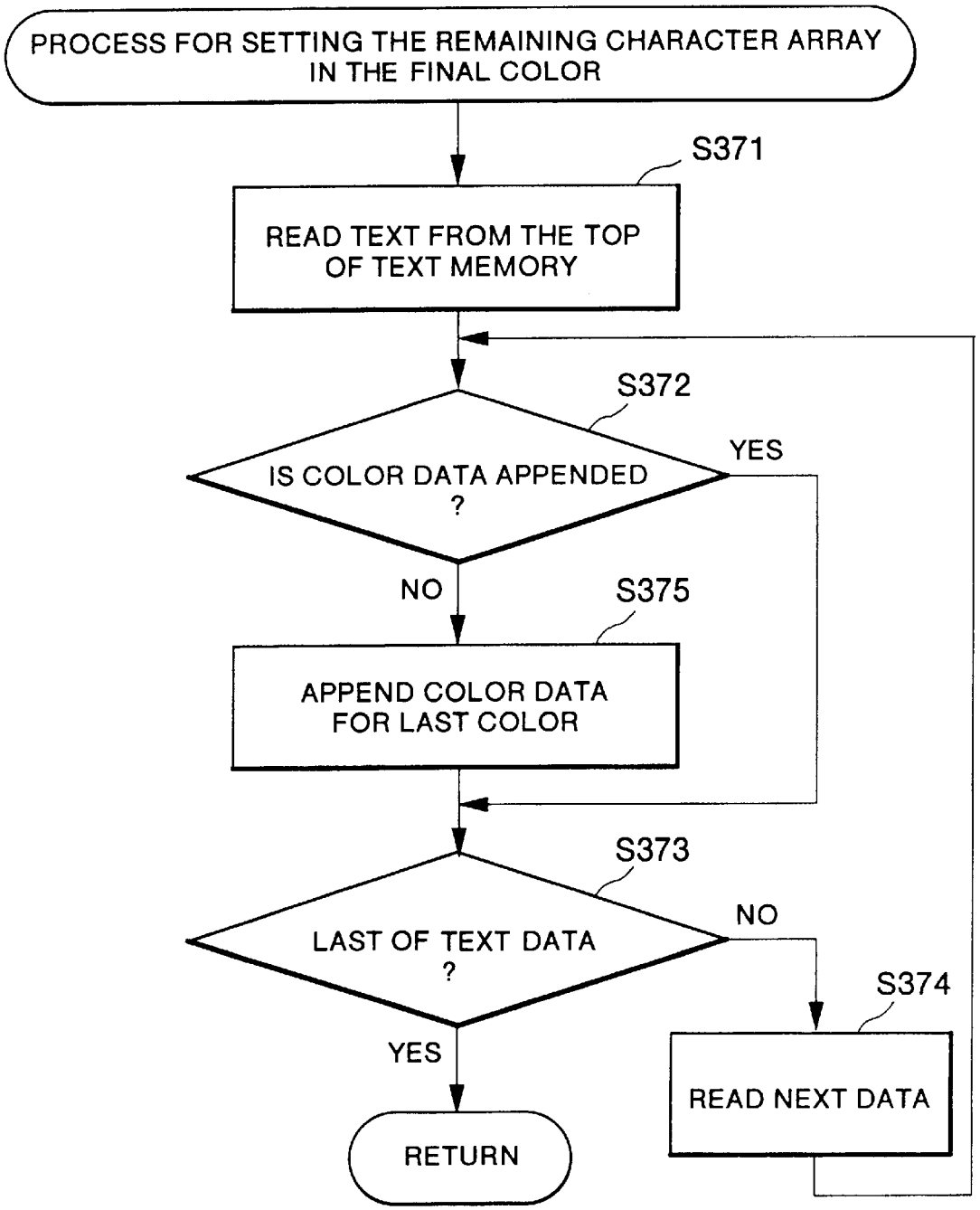
FIG. 20 is a flowchart representing a process control for setting the final printing color with respect to the remaining character array.

Next, the process for setting the character array will be described in detail with reference to FIG. 20. First, the character data stored in the text memory 121 is read from the top of the memory (S371). The data is checked to see if color data is appended or not (S372). If color data is appended to the read character data (S372:YES) and that character data is not the last of the character data (S373:NO), then the next data is read (S374), and the process is repeated from S372. However, if color data is not appended to the read character data (S372:NO), color data corresponding to the final printing color is appended to that character data and stored in memory (S375), and the process at S373 is executed. All of the above-mentioned processes are repeated until the end of the character data stored in the text memory 121. When the data is found at S373 to be the last of the character data (S373:YES), then control is returned to S38 of FIG. 19.

For example, when the character data "AB CDE "FG" is stored in the text memory 121, when the color number is set to "3," and when the color sequence is set to "red," "green," and "black," then during the process for setting the printing target character array in S35, first the character array "AB" is set for the printing color red by operating the cursor keys and the color set key. As shown in FIG. 27, the color data "red" is appended to the character data "A" and "B" of the text memory 121, and each combination of character data and color data is stored in the memory. Next, the character array "CDE" is set for the printing color "green," and the color data "green" is appended to the character data "C" "D" "E" of the text memory 121, and stored.

When setting of the printing color "green" is completed, the color number count value I is such that (I−1) is zero. Therefore, in the process for setting the character array in S37, the character data of the text memory 121 is read in order, beginning from the top of the memory. The character array "FG" of the text data, which has not been set to a printing color, is automatically set to the final printing color, "black" and the printing data "black" is then saved in the text memory 121, appended to the character data "F" and "G".

Next, the message "Margin for the printing tape?" is displayed in the display 5. The margins are set to the desirable size by operating the number keys, and the margin set is stored in the margin memory 124 (S38). Control is then returned to S14 for continuing the multi-color printing control.

Figure 21:
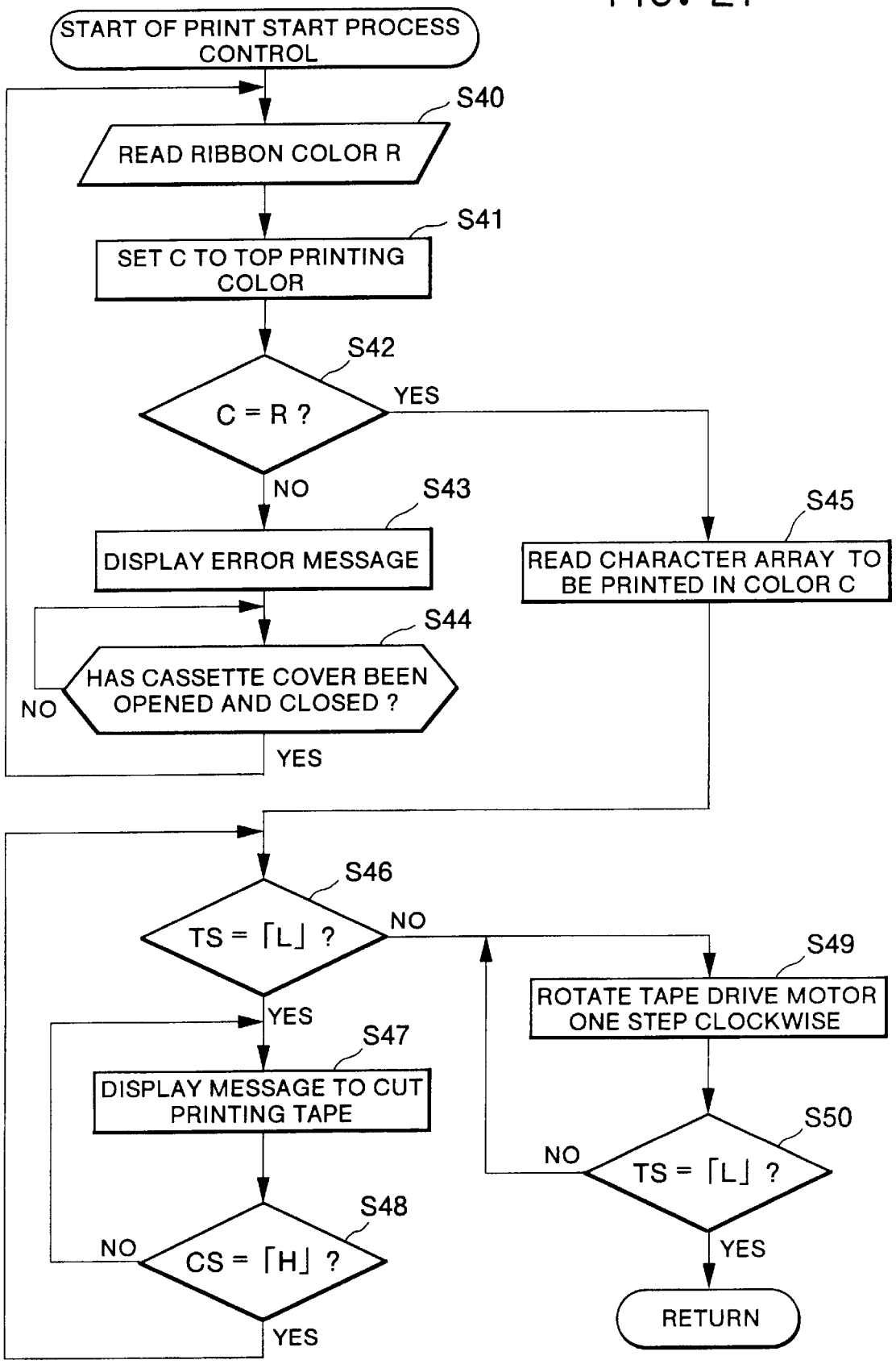
FIG. 21 is a flowchart representing a print start process control routine.

When the printing key is pressed in the multi-color printing control (S14:YES, S15:YES), the printing start process control (S16) is executed, as shown in FIG. 21.

When this process begins, first, the ribbon color R of the mounted ribbon cassette 30 is read (S40), based on ribbon detection signals RS from the group of ribbon detection switches 103. Then, the leading printing color C in the printing color sequence is read (S41). If the ribbon color R does not match the leading printing color C (S42:NO), then an error message is displayed in the display 5 (S43) indicating that the ribbon color does not match the printing color.

After the cassette cover 3 is opened, the ribbon cassette 30 is replaced, and the cassette cover 3 is closed again, then according to the cover open and close signals VS transmitted from the cover open and close detection switch 102, steps S40 and S41 are repeated. Then, if the ribbon color R matches the leading printing color C (S42:YES), the stored character array appended data of the leading printing color C is read from the text memory 121. Further, the dot pattern data of that character array is developed in the printing data buffer 125 (S45). Then, the tape detection signal TS is read from the tape detection sensor 91. If the tape detection signal TS is "L" level, meaning the printing tape 22 is positioned corresponding to the tape detection sensor 91 (S46:YES), then a message prompting that the printing tape be cut is displayed in the display 5 (S47).

Next, the cutting button 85 is pressed for cutting the printing tape 22, and the cut detection signal CS from the cut detection switch 101 becomes "H" level (S48:YES). Then, the tape detection signal TS becomes "H" level, meaning the tape cutting was detected (S46:NO), the tape drive motor 44 is driven one step only in the clockwise direction, and the printing tape 22 is moved a very small distance in the feeding direction T, in order for the leading edge of the tape to pass the tape detection sensor 91 (S49). As far as the tape detection signal TS maintains "H" level (S50:NO), steps S49 and S50 are repeated.

Figure 28A:
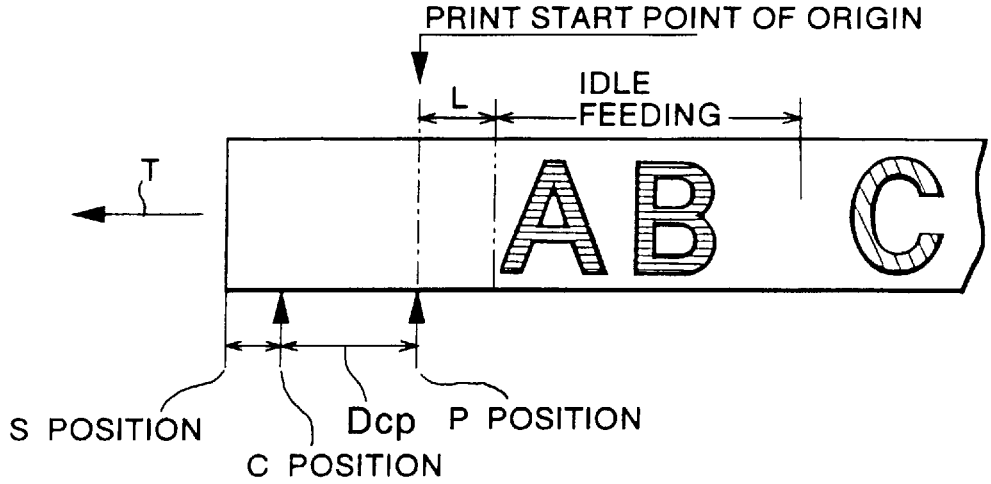
FIG. 28(*a*) is an explanatory diagram showing a print start point of origin on a tape.
Figure 28B:
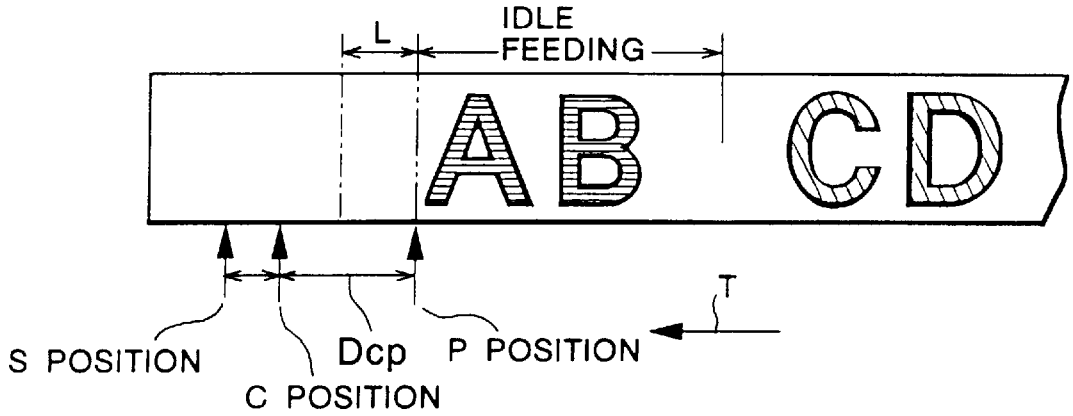
Figure 28C:
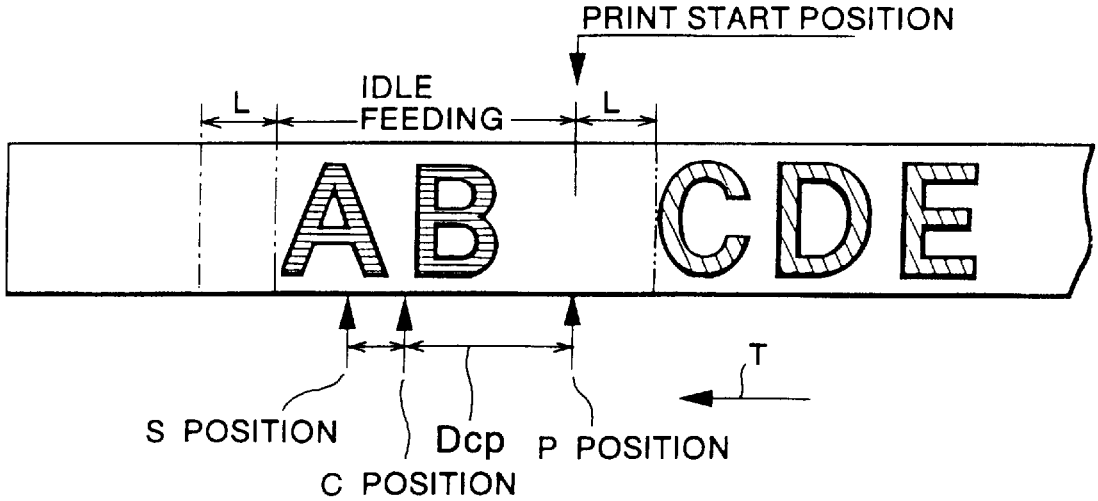

When the tape detection signal TS becomes "L" level, as shown in FIG. 28(*a*) signifying that the leading edge of the printing tape 22 has passed the tape detection sensor 91 (S50:YES), control is returned to S17 of the multi-color printing control. At this time, the printing position of the thermal head 12 corresponding to the printing tape 22 at the point when the leading edge of the tape was detected is set as the print start point of origin. When moving the printing tape 22 in the feeding direction T, even if the leading edge of the printing tape is curled, the leading edge of the printing tape can be reliably guided through the slit 98 by means of the guides 99 formed on the pair of guide members 94 and 95.

Figure 22:
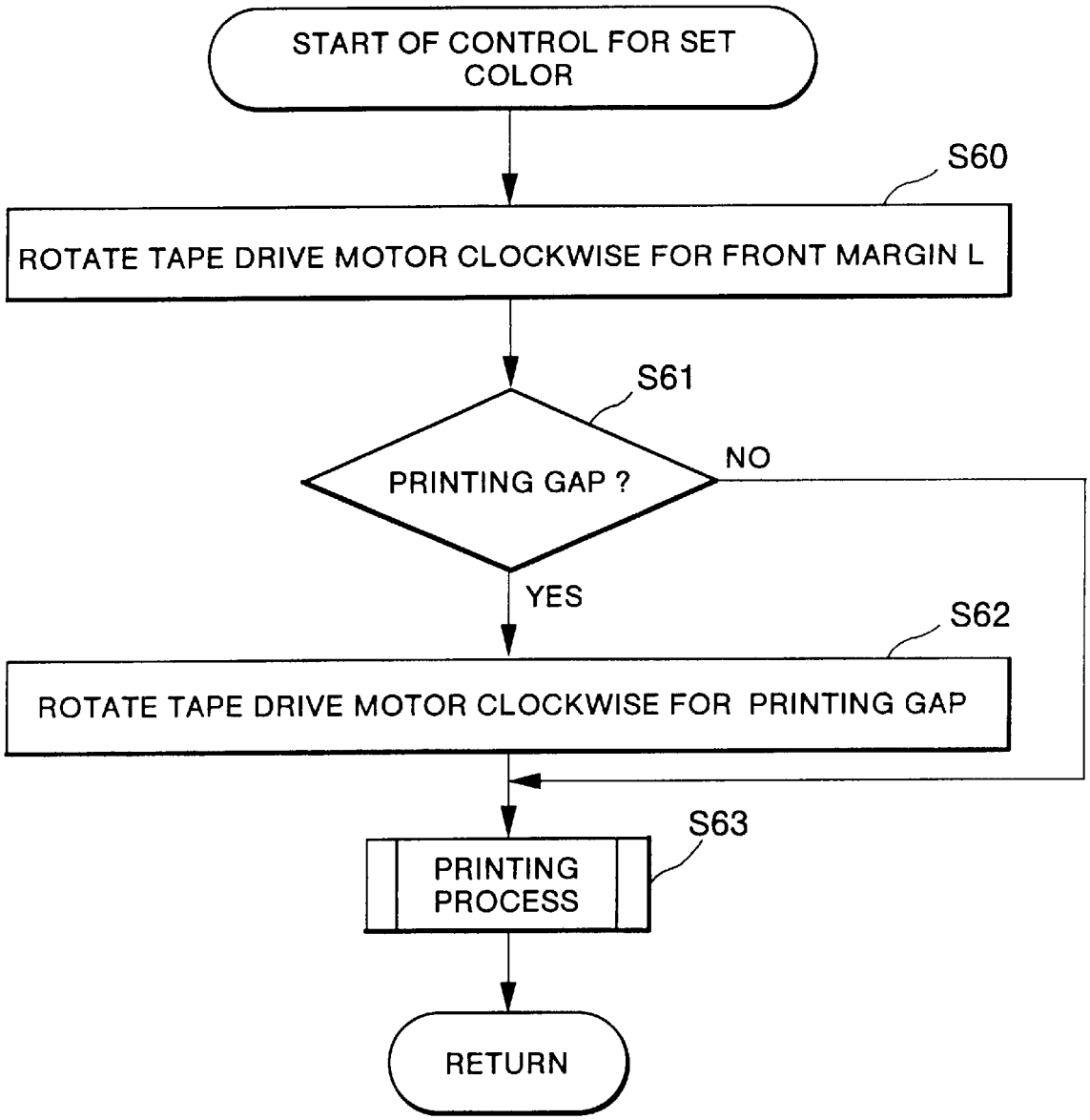
FIG. 22 is a flowchart representing a process for setting the color.

Next, in the multi-color printing control, when the color number N is not "1", that is, when the printing process is not on the last color (S17:NO), the process for setting the color (S18) is executed to print the selected printing color as shown in FIG. 22.

As shown in FIG. 28(*b*), when this control begins, first, the tape drive motor 44 is driven in the clockwise direction to move the printing tape the initial margin L corresponding to the set front margin L (S60). Then, if the printing start position of characters to be printed in the current printing color is positioned upstream in the feeding direction T of the print start point of origin in the label printing (S61:YES), for example, as shown in FIG. 28(*c*), if idle feeding (or feeding without printing) is required such that the characters "CDE" with the printing color "green" is to be printed, the tape drive motor 44 is driven in the clockwise direction, moving the printing tape 22 in the feeding direction T only the amount of the idle feeding (S62). However, when no idle feeding of the tape is required (S62:NO), the routine is skipped into the step S63 without executing the step S62. The dot pattern data developed in the printing data buffer 125 is read, and the printing process is executed by driving the thermal head 12, the tape drive motor 44, and the like for printing (S63). Control is then returned to S19 of the multi-color printing control.

Figure 23:
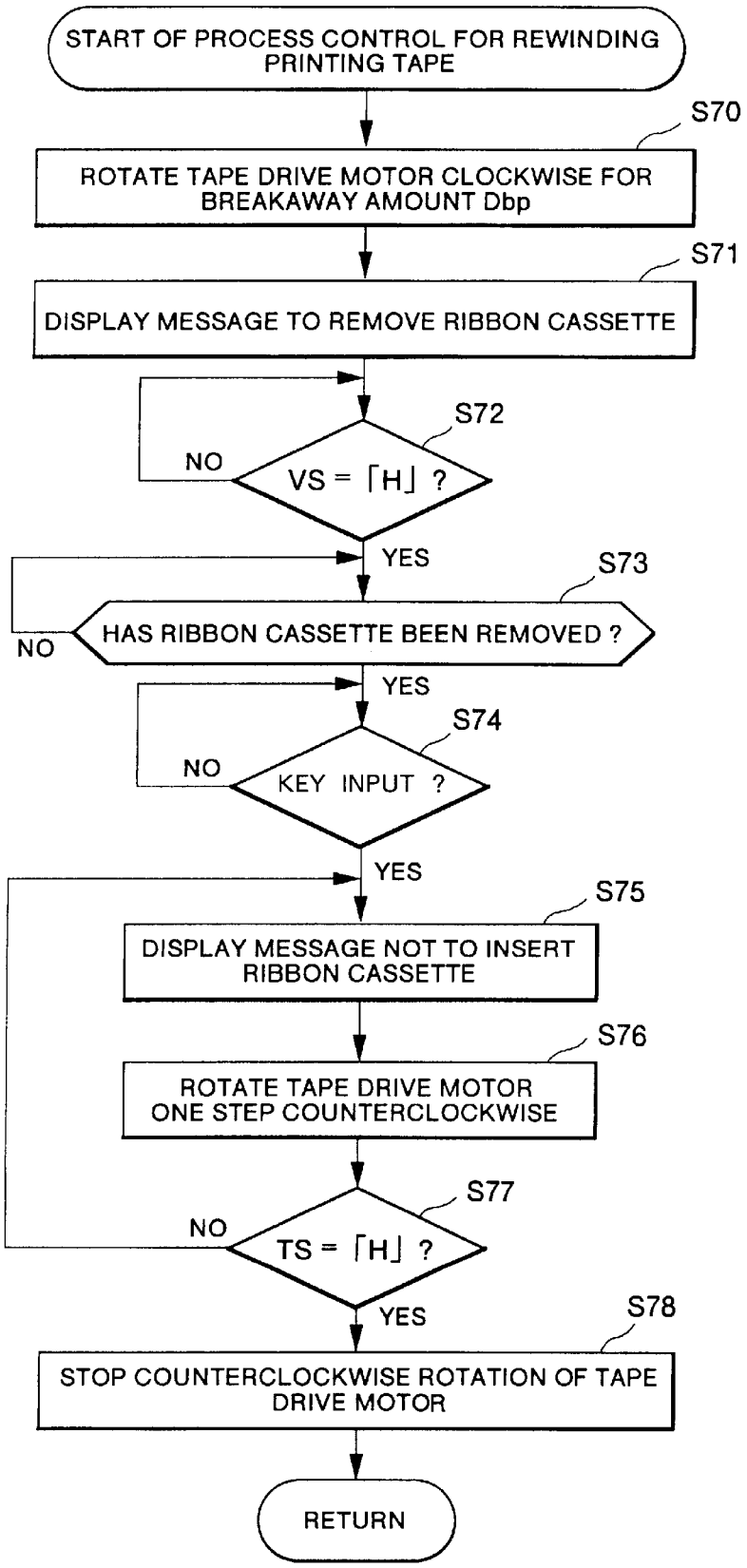
FIG. 23 is a flowchart representing a printing tape rewinding process control.
Figure 24:
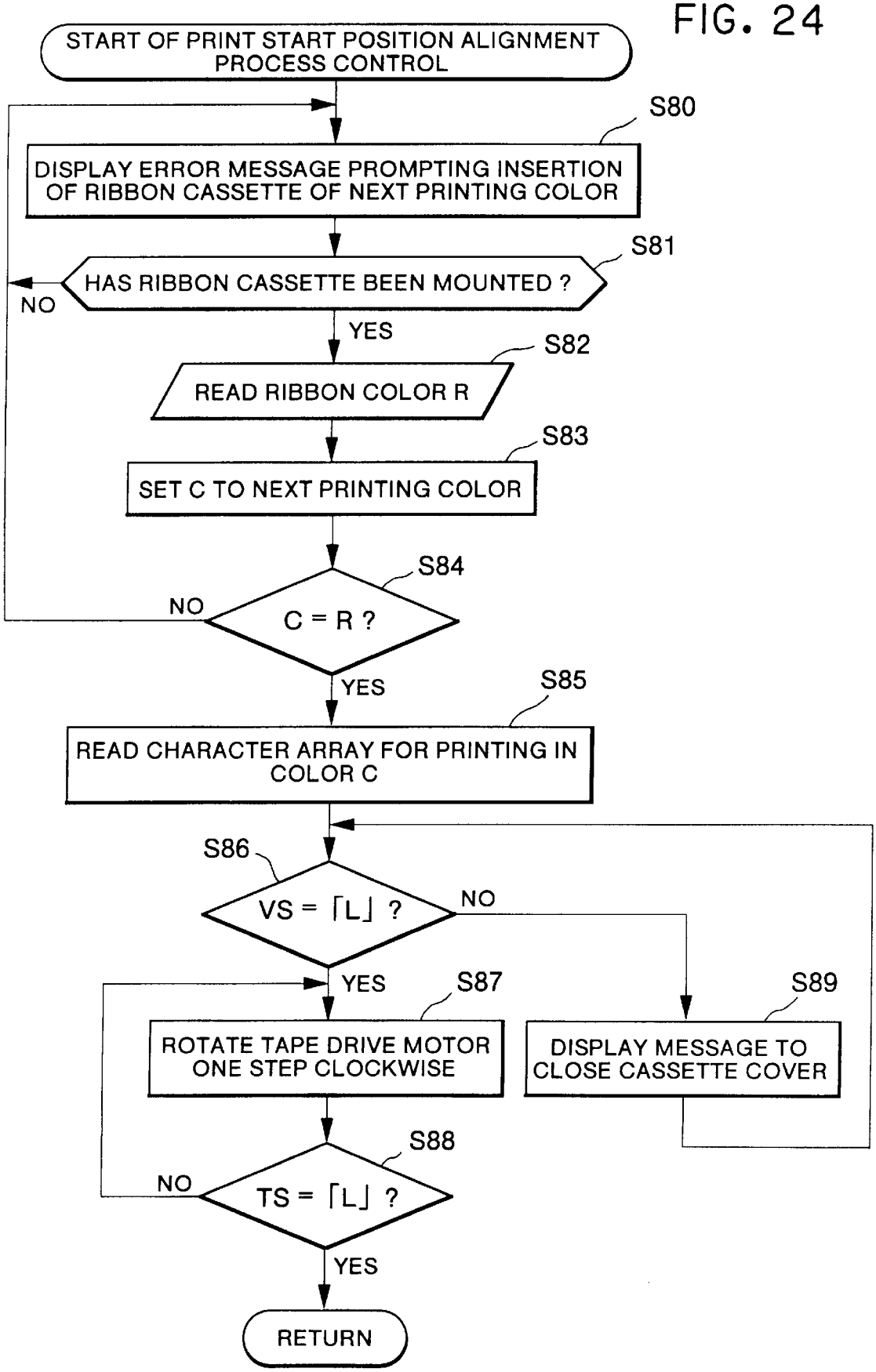
FIG. 24 is a flowchart representing a print start position alignment process control.

Next, in the multi-color printing control, the printing tape rewinding process control (S19) is executed as shown in FIG. 23.

When this control is begun, first, the tape driving motor 44 is driven in the clockwise direction, moving both the printing tape 22 and the ink ribbon 32 in the feeding direction T for only the separation feeding distance Dbp corresponding to the distance Dbp between the printing position (P position) and the separation position (B position) (S70). This feeding is required because the ink of the ink ribbon 32 is fused or melted to the printing tape 22 by the thermal head 12 at the final printing position. However, because the printing tape 22 and the ink ribbon 32 are moved for only the separation feeding distance Dbp, the ink ribbon 32 is forcibly pulled away from the printing tape by the separation portion 35*a*. Thus, the printing tape 22 and the ink ribbon 32 are separated with certainty.

Next, in order to replace the ribbon cassette 30 with one that has an ink ribbon 32 of the same color as the next printing color, a message prompting for the ribbon cassette 30 to be removed is displayed in the display 5 (S71). Then, the cassette cover 3 is opened, moving the operation plate 74 in the rearward direction, and an "H" level cover open and close signal VS is output from the cover open and close detection switch 102 (S72:YES). In addition, all six of the detection switch signals become "H" level signals, as the ribbon detection signal RS from the group of ribbon detection switches 103. When the ribbon cassette 30 has been removed (S73:YES), the routine waits until a key is inputted from the keyboard 4(S74).

When any key is operated so that there is key input (S74:YES), a message prompting the user not to insert another ribbon cassette 30 is displayed in the display 5 (S75). Next, to rewind the printing tape 22, the tape drive motor 44 is driven one step only in the counterclockwise direction, moving the printing tape 22 a very slight distance in the rewind direction (S76). During this rewinding operation, if the tape detection signal TS is "L" level (S77:NO), steps S75 through S77 are repeated. Then, if the leading edge of the printing tape 22 is rewound until it is slightly on the inner side of the tape detection sensor 91 (S77:YES), the counterclockwise rotation of the tape drive motor 44 is stopped (S78). Control is then returned to S20 of the multi-color printing control.

When, based on the ribbon detection signal RS from the ribbon detection switch group 103, it is detected that the ribbon cassette 30 is removed, then key input from any key will cause the tape drive motor 44 to be driven in the reverse rotational direction so that the print tape 22 is rewound. Therefore, even if the user accidentally presses a delete key provided on the keyboard 4, then, because the ribbon cassette 30 is not present, only the tape 22 will start rewinding. Printing processes will not be terminated. Accordingly, mishaps such as partially printed tape being wasted by printing processes being terminated midway when the user accidentally operates the delete button can be prevented.

Figure 30:
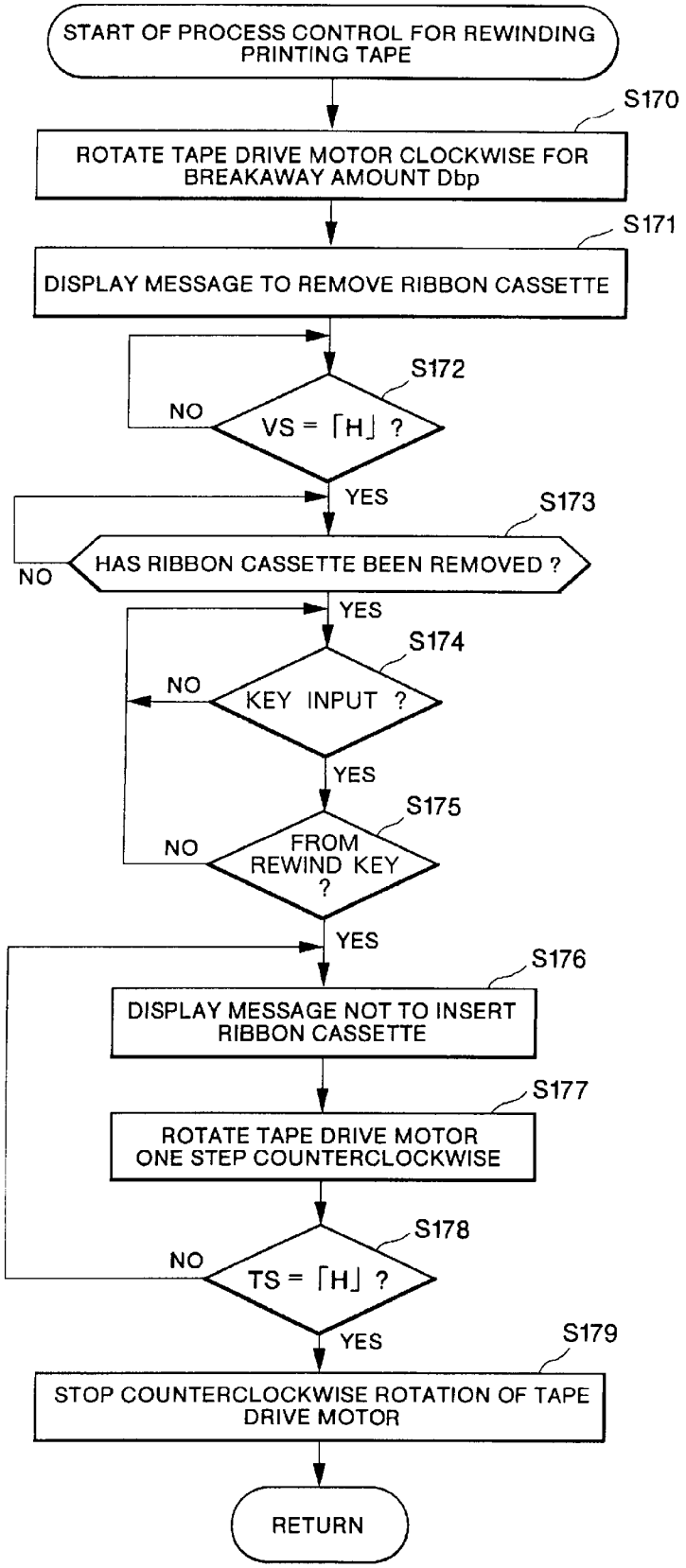
FIG. 30 is a flowchart schematically showing a print tape rewind routine according to another embodiment.

It should be noted that the above-described print tape rewind routine can be modified as indicated by FIG. 30.

Steps S170 through 173 of the print tape rewind routine shown in FIG. 30 are the same as steps S70 through S73 of the print tape rewind routine shown in FIG. 23, so their explanation will be omitted. Also, steps S176 through S179 indicated in FIG. 30 correspond to steps S75 through S78 shown in FIG. 23, so their explanation will be omitted. In the routine shown in FIG. 30, when a ribbon cassette 30 is removed (S173:YES), then key input from the keyboard 4 is awaited in S174. When a predetermined specific key, such as a tape rewind key, provided to the keyboard 4 is operated (S174, S175:YES), then the steps from S176 and on are executed so that the tape drive motor 44 is driven in the reverse rotational direction to rewind the print tape 22. When a key other than the tape rewind key is operated (S175:NO), then it will be determined that key input was received from an invalid key so that key input will again be awaited in S174.

In this way, in the print tape rewind routine shown in FIG. 30, when, based on the ribbon detection signal RS from the ribbon detection switch group 103, it is detected that the ribbon cassette 30 has been removed, then key input of the rewind key will cause the tape drive motor 44 to be driven in the reverse rotational direction so that the print tape 22 only is rewound. Key input from any other key will be considered invalid key input so that the label producing device will wait for new key input without operating. Therefore, even if the user accidentally presses a delete key provided on the keyboard 4, then printing operations will not be terminated. Accordingly, mishaps such as partially printed tape being wasted by printing processes being terminated midway when the user accidentally operates the delete button can be prevented.

When this control is begun, first, an error message prompting the user to insert a ribbon cassette 30 having an ink ribbon 32 of the same color as the next printing color is displayed in the display 5 (S80). Then, if all of the six switch signals making up the ribbon detection signal RS are not the "H" level, signifying that the ribbon cassette 30 is mounted (S81:YES), then the ribbon color R of the mounted ribbon cassette 30 is read based on the ribbon detection signals RS (S82). Then, the next printing color C of the printing color sequence is read (S83). If the ribbon color R does not match the next printing color C (S84:NO), then steps S80 through S84 are repeated.

When the ribbon color R matches the next printing color C (S84:YES), the stored character array appended with the color data for the next printing color C is read from the text memory 121. Further, dot pattern data for that character array is developed in the printing data buffer 125 (S85). Next, when the cassette cover 3 is not closed (S86:NO), a message prompting for the cassette cover 3 to be closed is displayed in the display 5 (S89). When the cassette cover 3 has been closed (S86:YES), the tape drive motor 44 is driven one step only in the clockwise direction, until the leading edge of the printing tape 22 corresponds to the tape detection sensor 91 (S87 and S88:NO). If the tape detection signal TS becomes "L" level when the leading edge of the printing tape 22 corresponds to the tape detection sensor 91, the print start point of origin for the printing tape 22 corresponds to the print position of the thermal head 12 (S88:YES). Control is then returned to S21 of the multi-color printing control.

Figure 25:
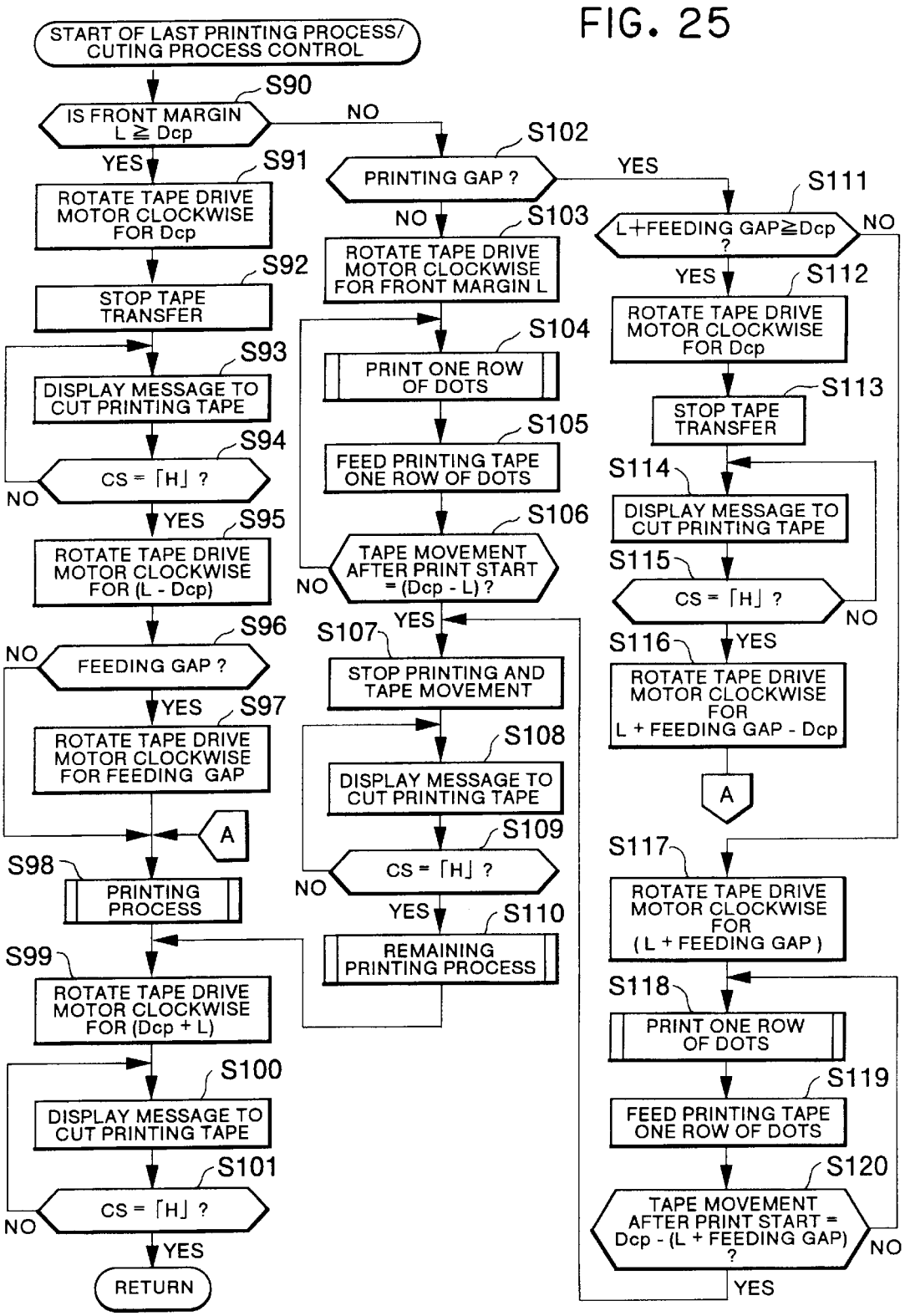
FIG. 25 is a flowchart representing a final color printing process and a cutting process control.

Next, in the multi-color printing control, the color number N is decremented by one (S21). If the color number is not "1," or not the final printing (S17:NO), steps S18 through S21 are repeated. If the color number N becomes "1," or the final printing (S17:YES), the final color printing process and cutting process control (S22) will be executed, as shown in FIG. 25.

This control is separated into four cases. In Case 1, the front margin L is greater than the distance Dcp between cutting and printing positions. In Case 2, the front margin L is smaller than the distance Dcp, and no idle feeding is provided. In Case 3, the front margin L is smaller than the distance Dcp, and idle feeding is provided, and further, the total length of the front margin L and the idle feeding is equal to or greater than the distance Dcp between the printing position and the cutting position. In Case 4, the front margin L is smaller than the distance Dcp, idle feeding is provided, and further, the total length of the front margin L and the idle feeding is smaller than the distance Dcp between the printing position and the cutting position.

First, Case 1 will be described. If the front margin L is greater than the distance Dcp (S90:YES), the printing tape 22 is moved only the distance Dcp in the feeding direction T by the tape drive motor 44 being driven in the clockwise direction (S91). Then, the drive of the tape drive motor 44 is stopped, stopping the tape movement (S92). Next, the tape drive motor 44 is rotated a little in the rewinding direction. When the end portion of the cut prevention lever 84 is removed from beneath the cutting lever 82, making the cutting operation possible, as shown in FIG. 15, a message prompting the user to cut the printing tape 22 is displayed in the display 5 (S93). Then, when the printing tape 22 is cut and the cutting detection signal CS becomes the "H" level, signifying the tape cutting has been detected (S94:YES), the printing tape 22 is moved in the feeding direction T by the remaining distance of the front margin L (front margin L−Dcp) (S95).

If the print start position of the last printing color is upstream from the print start point of origin of the label printing in the feeding direction T, and there exists an idle feeding (S96:YES), the tape drive motor 44 is driven in the clockwise direction, moving the printing tape 22 in the feeding direction T by the length of the idle feeding (S97). Then, the characters, symbols, and the like, based on the dot image data read similar to S63 described earlier, are printed in the final printing color (S98).

Next, in order to provide the rear margin L behind the printed character array, the tape drive motor 44 is driven in the clockwise direction, moving the printing tape 22 in the feeding direction T only by the distance Dcp plus the rear margin L (S99). Then, the tape drive motor 44 is rotated slightly in the rewinding direction. When the end portion of the cut prevention lever 84 is removed from beneath the cutting lever 82, making the cutting operation possible, a message prompting the user to cut the printing tape 22 is displayed in the display 5 (S100). Then, when the printing tape 22 is cut and the cutting detection signal CS becomes the "H" level, signifying that the tape cutting has been detected (S101:YES), control is returned to S10 of the multi-color printing control.

Next, Case 2 will be described. When the front margin L is less than the distance Dcp and no idle feeding exists (S90 and S102:NO), the tape drive motor 44 is driven in the clockwise direction, moving the printing tape 22 in the feeding direction T by the distance of the front margin L (S103). Then, the final printing process and cutting of the printing tape 22 is performed according to the steps beginning at S104.

More specifically, one row of the dot pattern data is read from the printing data buffer 125 and printing is performed with the one row of the dot pattern (S104). The tape drive motor 44 is driven in the clockwise direction, moving the printing tape 22 only by the short distance corresponding to the one row of dots (S105). If the amount of tape movement after the final printing has begun is less than the distance of the front margin L subtracted from the distance Dcp, that is, if the top position of the front margin has not yet reached the cutting position (C position) (S106:NO), then steps S104 through S106 are repeated.

When the top position of the front margin L has reached the cutting position (S106:YES), the printing and tape movement are stopped (S107). Then, the tape drive motor 44 is rotated slightly in the rewinding direction. When the end portion of the cut prevention lever 84 is removed from beneath the cutting lever 82, thereby making the cutting operation possible, then a message prompting the user to cut the printing tape 22 is displayed on the display (S108). Then, when the cutting button 85 is pressed, the printing tape 22 is cut, and the cutting detection signal CS becomes the "H" level, signifying the tape cutting has been detected (S109:YES), printing of the remaining dot pattern data to be printed is carried out (S110). The rear margin L is provided according to steps S99 through S101, and the tape is cut, and control is returned to S10.

Next, Case 3 will be described. When the front margin L is smaller than the distance Dcp between the printing position and the cutting position, and an idle feeding exists and the total length of this idle feeding and to the front margin L is greater than the distance Dcp (S90:No, S102 and S111:YES), the tape is moved as in the previously described steps S91 through S94, and the tape is cut (S112 through S115). Further, the printing tape 22 is moved in the feeding direction T by the distance (front margin L+idle feeding−Dcp) (S116). Then, the steps beginning from S98 are executed, so that printing in the final color is performed, and the rear margin L is provided, and the tape is cut. Control is then returned to S10.

Finally, Case 4 will be described. When the front margin L is smaller than the distance Dcp, and an idle feeding exists and the value of this idle feeding added to the front margin L is less than the distance Dcp (S90:No, S102:YES, S111:NO), then the printing tape 22 is moved in the feeding direction T by the distance of the total length of the front margin L and the idle feeding (S117). Then one row of the dot pattern data is read from the printing data buffer 125 and printing is performed (S118). The tape drive motor 44 is driven in the clockwise direction, moving the printing tape 22 only by the short distance corresponding to the one row of dots (S119).

Figure 29:
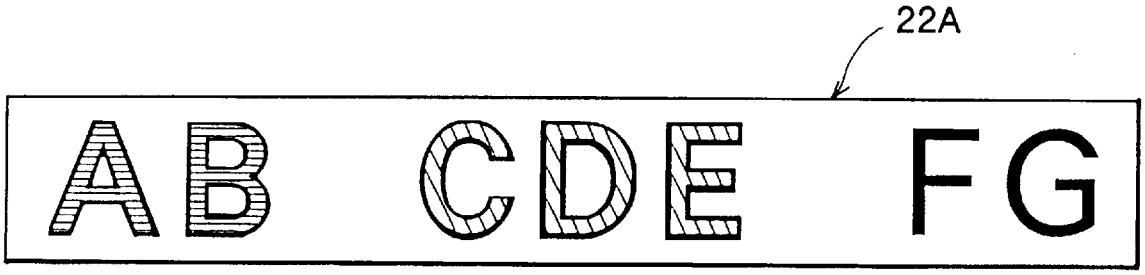
FIG. 29 is a plan view showing the tape-shaped label printed in three colors.

When the amount of tape movement after the final printing has begun is less than the difference between the distance Dcp and the total length of the front margin L and the idle feeding length, that is, the top position of the front margin L has not yet reached the cutting position, (S120:NO), then steps S118 through S120 are repeated. When the top position of the front margin L has reached the cutting position (S120:YES), the steps beginning from S107 are executed. Both the front margin L and the rear margin L are provided, and the tape is cut. Control is then returned to S10. As in the example of the input text "AB CDE FG" shown in FIG. 29, a label was obtained with the front and rear margins L provided, the character array "AB" printed in red, the character array "CDE" printed in green, and the character array "FG" printed in black.

Next, the operations of the multi-color printing process will be described.

After input of text, a print color number setting process for setting the number N of print colors and the color sequence is executed. Also, a process for setting the target range to be printed for each print color is executed in order to print in multiple colors. After the ribbon cassette 30 with the same ribbon color R as the leading printing color C has been mounted, a printing process is performed by controlling drive of the thermal head 12 and the tape drive motor 44. Each time a ribbon cassette 30 is exchanged and then a printing process for that color ink ribbon is completed, a printing tape rewinding process is executed.

That is, while the print tape 22 is being rewound, the head release mechanism 70 is operated to its release position based on the cover open/close signal VS from the cover open/close detection switch 102. Also, when all six detection switch signals of the ribbon detection signal RS from the ribbon detection switch group 103 are H-level signals, which indicates that the ribbon cassette 30 has been removed from the tape cassette 20, then a message telling the user not to mount a ribbon cassette 30 is displayed on the display 5 and input from an optional key (or a specific key, depending on the design of the print tape rewind routine) of the keyboard 4 is awaited.

When there is input from an optional key (or from the specific key) of the keyboard 4, then the tape drive motor 44 is driven to rotate in the reverse rotational direction so that the print tape 22 is automatically rewound. Then, the print tape 22 is stopped at its print start reference point position based on the tape detection signal TS from the tape detection sensor 91.

In this way, after completion of each printing operation, when a selectively mounted ribbon cassette 30 of the plurality of ribbon cassettes 30 prepared for multi-colored printing is detected as having been removed from the tape cassette 20 and then there is input from the optional (or specific key) of the keyboard 4, then the ribbon tape movement mechanism 40 transports the print tape 22 in the rewind direction. Although the ribbon take-up spool 34 in the ribbon cassette 30 would be driven to rewind in association with this, because the ribbon cassette 30 is not present, the ink ribbon 32 can be reliably prevented from being rewound without providing any kind of connection release mechanism for preventing the ribbon take-up spool 34 in the ribbon cassette 30 from being driven to be rewound.

Also, print tape 22 in the middle of being printed will not be wasted by print processes being terminated by the user accidentally touching the delete key while removing the ribbon cassette 30. The user can avoid any frustration this might cause.

While the invention has been described in detail with reference to specific embodiments thereof, it would be apparent to those skilled in the art that various changes and modifications may be made therein without departing from the spirit of the invention, the scope of which is defined by the attached claims.

For example, the tape-shaped label printing device of the present invention can be configured so that when rewinding the printing tape 22, the edge of the printing tape 22 can be detected by the tape status switching from indicating a tape present to no tape present based on the tape detection signal TS outputted from the tape detection sensor 91. Also, the group of ribbon detection switches 103 can be configured from a variety of sensors, such as a proximity switch or a photointerrupter. Further, it is obvious that the present invention can be applied to various tape-shaped label printers 1 for printing in multiple colors by exchanging in sequence a plurality of ribbon cassettes 30 with differing ribbon colors.

As is clear from the above explanation, according to the present invention, with completion of each print process and after each detection of the ribbon cassette being removed, key input from the input device will cause the tape movement mechanism to start moving the print tape in the rewind direction. Although the ribbon take-up spool would be driven in association with this if the ribbon cassette were present, because the ribbon cassette is not present, the ink ribbon can be reliably prevented from being rewound without providing any kind of connection release mechanism for preventing rewind drive of the ribbon take-up spool in association with this rewinding operation.

Also, even if the user accidentally touches the input device so that key input is performed while removing the ribbon cassette, all that will happen is that the tape will rewind. Since the print processes will not be terminated, print tapes printed only part way will not be wasted.

The tape-shaped label producing device according to the present invention automatically rewinds the print tape after completion of each printing operation.

What is claimed is:

1. A tape cassette comprising:

a cassette housing having a head recess;

a tape wound on a tape spool supported within the housing for feeding tape to the head recess;

a feed capstan downstream of the head recess for drawing the tape from the tape spool;

a feed path along which the tape moves from the tape spool, across the head recess and to the feed capstan;

a recess in the cassette housing adjacent the feed capstan and having a length extending in the feed path on opposite sides of the feed capstan, a first end of the recess being located upstream of the feed capstan and downstream of the head recess, a second end of the recess being located downstream of the feed capstan, the length of the recess between the first and second ends of the recess being larger than a diameter of the feed capstan;

first and second tape regulating members extending from the cassette housing and across the tape, the first and second tape regulating members being respectively located near the first and second ends of the recess for positioning the tape in the recess between the feed capstan and the first and second tape regulating members;

wherein the recess receives a drive roller for driving the tape in a nip between the feed capstan and the drive roller, the drive roller when received in the recess being located between the first and second tape regulating members so that the drive roller contacts the tape without contacting the first and second tape regulating members and the cassette housing.

2. The tape cassette of claim 1, wherein the recess is an arcuate recess.

3. The tape cassette of claim 1 wherein a diameter of the recess is larger than a diameter of the feed capstan.

4. A tape cassette for a printing device, comprising:

a cassette casing comprising upper and lower surfaces and a lateral surface extending between the upper and lower surfaces, the cassette casing housing a printing tape and defining a feed path through which the tape moves in a feeding direction, the cassette casing defining a head recess adapted to receive a print head of the printing device, the cassette casing further including a feed capstan adjacent a first corner of the cassette casing downstream of the head recess in the feed direction and adapted to engage a drive roller of the printing device to feed the tape in the feeding direction; and a recess in the lateral wall near the first corner of the cassette casing and downstream of the head recess, the recess exposing the feed capstan and having a size in the feeding direction larger than the feed capstan;

first and second tape regulating members extending from the cassette housing and across the tape, the first and second tape regulating members being located at each end of the recess, wherein the recess receives the drive roller for driving the tape in a nip between the feed capstan and drive roller, the drive roller being located between the first and second tape regulating members and contacting the tape in the nip without contacting the first and second regulating members and the cassette casing.

5. The tape cassette of claim 4 wherein the recess is an arcuate recess having a diameter in the feeding direction larger than a diameter of the feed capstan.

6. A tape cassette for a printing device, comprising:

a cassette casing comprising upper and lower surfaces and a lateral surface extending between the upper and lower surfaces, the cassette casing housing a printing tape and defining a feed path through which the tape moves in a feeding direction, the cassette casing defining a head recess adapted to receive a print head of the printing device, the cassette casing further including a feed capstan adjacent a first corner of the cassette casing downstream of the head recess in the feed direction and adapted to engage a drive roller of the printing device to feed the tape in the feeding direction; and a recess in the lateral wall near the first corner of the cassette casing and downstream of the head recess, the recess exposing the feed capstan and having a size in the feeding direction larger than the feed capstan;

first and second tape regulating members extending from the cassette housing and across the tape, the first and second tape regulating members being located at each end of the recess, the first tape regulating member being located upstream of the feed capstan and downstream of the head recess, and the second tape regulating member being located downstream of the feed capstan, wherein the recess receives the drive roller for driving the tape and the first and second tape regulating members suppress displacement of the tape from traveling outside of the recess due to contact between the tape and drive roller inside of the recess.

7. A tape cassette for use with a printing device that includes a print head and an array of sensors, the tape cassette comprising:

printing tape; and a cassette casing housing the printing tape, the cassette casing having first and second corners defining:

a feed path through which the printing tape moves in a feeding direction;

a head recess adapted to receive the print head of the printing device;

a recess disposed adjacent the first corner of the cassette casing and downstream of the head recess in the feeding direction, the recess defining first and second ends;

first and second tape regulating members respectively located near the first and second ends of the recess, the first and second tape regulating members guiding the printing tape on the feed path; and a detector surface adapted to interact with the array of sensors of the printing device to identify at least one characteristic of at least one of the tape cassette and printing tape, the detector surface being disposed adjacent the second corner of the cassette casing.

8. The tape cassette according to claim 7, wherein the first and second tape regulating members minimize movement of the printing tape in a direction that extends at an angle to the feed path.

9. The tape cassette according to claim 7, further including a feed capstan that is disposed adjacent an opposite side of the feed path from the recess, the feed capstan being engageable with a tape drive of the printing device to feed the printing tape along the feed path in the printing direction.

10. The tape cassette according to claim 7, wherein the second corner of the cassette casing is most distant from the first corner.

11. The tape cassette according to claim 7, wherein the cassette casing comprises top and bottom surfaces and a lateral surface extending between the top and bottom surfaces, the detector surface being formed on a flanged portion extending from the lateral surface.

12. The tape cassette according to claim 7, wherein the second corner of the cassette casing is diagonally opposite from the first corner.

13. The tape cassette according to claim 12, wherein the detector surface defines at least one hole formed at a specific position therein spaced from an outer edge of the cassette casing to receive a selected sensor of the array of sensors of the printing device within the hole to facilitate identification of the at least one characteristic.

14. The tape cassette according to claim 7, wherein the cassette casing defines a tape exit portion adjacent the first corner, the second corner being most distant from the first corner.

15. The tape cassette according to claim 7, wherein the cassette casing comprises top and bottom surfaces and a lateral surface extending between the top and bottom surfaces, the sensor portion being formed on a flanged portion extending outwardly from the cassette casing substantially perpendicular to the lateral surface.

16. The tape cassette according to claim 7, wherein the detector surface defines multiple sensor holes that interact with the array of sensors of the printing device.

17. The tape cassette according to claim 16, wherein the multiple sensor holes are aligned so as to form multiple rows, each row being defined by at least one sensor hole.

18. The tape cassette according to claim 17, wherein the multiple sensor holes are aligned so as to form two rows.

19. The tape cassette according to claim 18, wherein the multiple sensor holes are aligned so as to form an L-shape.

20. The tape cassette according to claim 19, wherein each of the multiple sensor holes is round.

21. The tape cassette according to claim 7, further including a drive roller, a drive shaft of the printing device being insertable within the drive roller.

22. The tape cassette according to claim 21, wherein the drive roller is received between the first and second tape regulating members so as to be able to contact the printing tape on the feed path without contacting the cassette casing.

23. A tape cassette for use with a printing device that includes a print head, a drive roller, and an array of sensors, the tape cassette comprising:

printing tape; and a cassette casing housing the printing tape, the cassette casing having first and second corners and defining:

a feed path through which the printing tape moves in a feeding direction;

a head recess adapted to receive the print head of the printing device;

a recess disposed adjacent the first corner of the cassette casing and downstream of the head recess in the feeding direction, the drive roller of the tape cassette being receivable within the recess so as to be able to contact the printing tape on the feed path without contacting the cassette casing; and a detector surface adapted to interact with the array of sensors of the printing device to identify at least one characteristic of at least one of the tape cassette and printing tape, the detector surface being disposed adjacent the second corner of the cassette casing.

24. The tape cassette according to claim 23, further including a feed capstan that is disposed adjacent an opposite side of the feed path from the recess, the feed capstan being engageable with the tape drive of the printing device to feed the printing tape along the feed path in the printing direction.

25. The tape cassette according to claim 23, wherein the second corner of the cassette casing is most distant from the first corner.

26. The tape cassette according to claim 23, wherein the cassette casing comprises top and bottom surfaces and a lateral surface extending between the top and bottom surfaces, the detector surface being formed on a flanged portion extending from the lateral surface.

27. The tape cassette according to claim 23, wherein the second corner of the cassette casing is diagonally opposite from the first corner.

28. The tape cassette according to claim 27, wherein the detector surface defines at least one hole formed at a specific position therein spaced from an outer edge of the cassette casing to receive a selected sensor of the array of sensors of the printing device within the hole to facilitate identification of the at least one characteristic.

29. The tape cassette according to claim 23, wherein the cassette casing defines a tape exit portion adjacent the first corner, the second corner being most distant from the first corner.

30. The tape cassette according to claim 23, wherein the cassette casing comprises top and bottom surfaces and a lateral surface extending between the top and bottom surfaces, the sensor portion being formed on a flanged portion extending outwardly from the cassette casing substantially perpendicular to the lateral surface.

31. The tape cassette according to claim 23, wherein the detector surface defines multiple sensor holes that interact with the array of sensors of the printing device.

32. The tape cassette according to claim 31, wherein the multiple sensor holes are aligned so as to form multiple rows, each row being defined by at least one sensor hole.

33. The tape cassette according to claim 32, wherein the multiple sensor holes are aligned so as to form two rows.

34. The tape cassette according to claim 33, wherein the multiple sensor holes are aligned so as to form an L-shape.

35. The tape cassette according to claim 34, wherein each of the multiple sensor holes is round.

36. The tape cassette according to claim 24, wherein a length of the recess in the feed path is larger than a diameter of the feed capstan.

37. The tape cassette according to claim 23, wherein a length of the recess in the feed path is larger than a diameter of the drive roller of the printing device.

38. The tape cassette according to claim 23, wherein the recess is an arcuate recess.

39. The tape cassette according to claim 24, wherein a first end of the recess is upstream of the feed capstan and a second end of the recess is downstream of the feed capstan in the feeding direction.

* * * * *